US010443892B2

(12) United States Patent
Rumens et al.

(10) Patent No.: US 10,443,892 B2
(45) Date of Patent: Oct. 15, 2019

(54) MODULAR LINEAR FIREPLACE SYSTEM, ASSEMBLIES AND METHODS

(71) Applicant: Travis Industries, Inc., Mukilteo, WA (US)

(72) Inventors: Kurt W. F. Rumens, Kirkland, WA (US); Alan R. Atemboski, Renton, WA (US); William Ross Fotheringham, Everett, WA (US); Nicholas Barber, Mukilteo, WA (US)

(73) Assignee: Travis Industries, Inc., Mukilteo, WA (US)

( * ) Notice: Subject to any disclaimer, the term of this patent is extended or adjusted under 35 U.S.C. 154(b) by 536 days.

(21) Appl. No.: 14/639,935

(22) Filed: Mar. 5, 2015

(65) Prior Publication Data

US 2015/0253037 A1 Sep. 10, 2015

Related U.S. Application Data

(60) Provisional application No. 61/949,208, filed on Mar. 6, 2014.

(51) Int. Cl.
*F24H 9/06* (2006.01)
*F24C 3/14* (2006.01)
(Continued)

(52) U.S. Cl.
CPC ..... *F24H 9/02* (2013.01); *F24B 1/192* (2013.01); *F24B 1/199* (2013.01); *F24C 3/00* (2013.01);
(Continued)

(58) Field of Classification Search
CPC ..... F24H 9/06; F24C 3/14
(Continued)

(56) References Cited

U.S. PATENT DOCUMENTS 4,470,399 A * 9/1984 Pitha ..... F24B 1/1885 126/500
4,478,208 A * 10/1984 Pitha ..... F24B 1/1885 110/336

(Continued)

OTHER PUBLICATIONS

IKEA, How to install your IKEA kitchen, Jul. 31, 2014, time 0:51/1:56, https://www.youtube.com/watch?v=BmEEOHplctc.*

(Continued)

*Primary Examiner* — Steven B McAllister
*Assistant Examiner* — Desmond C Peyton
(74) *Attorney, Agent, or Firm* — Perkins Coie LLP

(57) ABSTRACT

A linear fireplace system, assemblies, modular units, and related methods that can be installed in a modular fashion at a selected installation location so as to avoid drawbacks experienced in the prior art. The system can include modular linear units, corner units, and/or end units interconnectable to form a modular linear fireplace assembly. The system can include an alignment track system with a track member that receives alignment rails on the bottom of the modular units to axially align the interconnected units. The system can include a combustion air flow passage within the fireplace that maintains a relatively low exterior temperature of the assembly and that allows combustible and non-combustible building materials to be installed against or immediately adjacent to the top and base portions of the modular units of the assembly.

23 Claims, 26 Drawing Sheets

(51) Int. Cl.

| | |
|---|---|
| ***F24H 9/02*** | (2006.01) |
| ***F24H 3/00*** | (2006.01) |
| ***F24B 1/192*** | (2006.01) |
| ***F24B 1/199*** | (2006.01) |
| ***F24C 3/00*** | (2006.01) |

(52) U.S. Cl.
CPC ..... *F24C 3/14* (2013.01); *F24H 3/006* (2013.01); *F24H 9/06* (2013.01)

(58) Field of Classification Search
USPC ..... 126/512, 519, 523, 500
See application file for complete search history.

(56) References Cited

U.S. PATENT DOCUMENTS 4,726,351 A * 2/1988 Whittaker ..... F24C 3/006 126/512
4,764,108 A * 8/1988 Carthew ..... F27B 9/029 432/128
4,890,600 A * 1/1990 Meyers ..... F24C 7/004 126/512
5,186,161 A * 2/1993 Shumock ..... F24B 1/191 126/500
5,249,567 A * 10/1993 Maitland ..... F24B 1/181 126/307 R
5,542,407 A * 8/1996 Hawkinson ..... F24B 1/1808 126/193
6,024,085 A * 2/2000 Hodge ..... F24B 1/18 110/336
6,029,655 A * 2/2000 Hussong ..... F23J 13/025 126/312
6,053,165 A * 4/2000 Butler ..... F24C 3/006 126/500
6,615,519 B2 * 9/2003 Hess ..... F24C 7/004 392/348
6,681,759 B2 * 1/2004 Bentulan ..... A47J 37/0704 126/25 R
6,799,727 B2 * 10/2004 Webster ..... F24C 7/004 237/46
6,880,275 B2 * 4/2005 Mix ..... F24C 7/004 126/500
6,944,982 B2 * 9/2005 Schroeter ..... F21S 10/04 392/348
7,066,170 B1 * 6/2006 Atemboski ..... F24B 1/1808 126/502
7,140,364 B1 * 11/2006 Buffington ..... F24B 1/18 126/500
7,194,830 B2 * 3/2007 Hess ..... F24C 7/004 392/348
7,322,819 B2 * 1/2008 Lyons ..... F24B 1/1808 126/500
7,566,220 B1 * 7/2009 Thompson ..... F23C 7/008 126/512
7,673,408 B2 * 3/2010 Hess ..... F24C 7/004 40/219
7,770,312 B2 * 8/2010 Stinson ..... F24C 7/004 40/428
7,789,660 B2 * 9/2010 Tenzek ..... F27B 9/029 219/672
8,234,803 B2 * 8/2012 Gallo ..... F21S 10/04 392/348
8,361,367 B2 * 1/2013 Hess ..... F24B 1/1808 264/225
8,424,512 B2 * 4/2013 Dettloff ..... F24C 3/12 126/39 B
8,511,293 B2 * 8/2013 Thompson ..... A47B 77/02 126/25 R
8,578,585 B2 * 11/2013 Dettloff ..... F24C 3/12 126/19 R
8,931,218 B2 * 1/2015 Raboine ..... E04H 1/1205 126/500
9,101,244 B2 * 8/2015 Samaras ..... A47J 37/0704
2008/0256891 A1 10/2008 Raboine
2009/0320403 A1 12/2009 Love et al.
2014/0116265 A1 * 5/2014 Samaras ..... A47J 37/0704 99/445

OTHER PUBLICATIONS

"International Search Report & Written Opinion; PCT/US2015/19054; dated Sep. 7, 2015; 10 Pages.".

* cited by examiner

MODULAR LINEAR FIREPLACE SYSTEM, ASSEMBLIES AND METHODS

CROSS REFERENCE TO RELATED APPLICATION

This U.S. Non-Provisional Patent Application hereby claims the benefit of and priority to U.S. Provisional Patent Application No. 61/949,208, titled "Modular Linear Fireplace System, Assemblies and Methods," filed Mar. 6, 2014, which is incorporated herein in its entirety by reference thereto.

TECHNICAL FIELD

Embodiments of the present invention are directed to fireplace assemblies, and more particularly, to gas-burning, linear fireplaces.

BACKGROUND

Gas-burning, linear fireplaces have become very popular as decorative signature pieces in homes, buildings, and the like. Large linear fireplaces are typically custom-built or semi-custom-built for a designated space. Large custom linear fireplaces are often very expensive to build and to install. The large custom linear fireplaces are usually fully built off-site, and installation of the fireplaces often requires partial removal of walls or other building structures to allow the fireplaces to be moved as a single unit to the installation site and into position for installation in the designated room. This fireplace installation process can be extremely expensive, time-consuming, and labor-intensive.

Conventional linear fireplace assemblies are also constructed in a manner that, during operation of the fireplace, the external surfaces of the fireplace can reach temperatures that far exceed 172° F. As a result, the installation requirements for the linear fireplaces prohibit the use of combustible building materials against or immediately adjacent to the fireplace. This restriction to only non-combustible materials surrounding the fireplace can significantly add to the fireplace installation costs and limit the choice of decorative materials used in the room that houses the linear fireplace.

SUMMARY

The present invention is directed to a linear fireplace system, assemblies, modular units, and related methods that can be installed in a modular fashion at a selected installation location so as to avoid drawbacks experienced in the prior art. In at least one embodiment, the system includes modular linear units, corner units, and/or end units that can be interconnected to form a modular linear fireplace assembly. The system can include an alignment track system with a track member that receives alignment rails on the bottom of the modular units to axially align the interconnected units. The system can include a combustion air flow passage within the fireplace that maintains a relatively low exterior temperature of the assembly and that allows combustible and non-combustible building materials to be installed against or immediately adjacent to the top and base portions of the modular units of the assembly.

Another embodiment provides a modular linear fireplace system comprising a plurality of linear fireplace units each having opposing first attachment end portions with configurations common to the linear fireplace units, wherein the linear fireplace units are interchangeable. Each fireplace unit has a base portion and a top portion spaced apart from the base portion to define a firebox therebetween in which combustion of a fuel gas occurs during use. The base portion has a gas line and a burner assembly operatively connected to the gas line. The burner assembly is positioned adjacent to a bottom portion of the firebox. The firebox has open lateral end portions adjacent to the first attachment end portions, wherein each linear fireplace unit is interchangeably securable to a second one of the linear fireplace units at one of the first attachment end portions to form joined linear fireplace units and to provide a continuous elongate firebox area through the joined linear fireplace units. The system has a plurality of end units each having second attachment end portions with common configurations that mate with the first attachment end portions of any one of the linear fireplace units. Each end unit is interchangeably connectable to a selected one of the linear fireplace units to close one of the open lateral end portions of the firebox of the any one of the linear fireplace units.

Another embodiment provides a modular linear fireplace assembly comprising first and second modular linear fireplace units each having opposing first and second attachment end portions with common configurations, wherein the linear fireplace units are interchangeable with each other. Each fireplace unit has a base portion and a top portion spaced apart from the base portion to define a firebox therebetween in which combustion of a fuel gas occurs during use. The base portion has a gas line and a burner assembly operatively connected to the gas line, and the burner assembly is positioned adjacent to a bottom portion of the firebox. The firebox has open lateral end portions adjacent to the first and second attachment end portions. A first modular end unit has at least a first end portion connected to the first attachment end portion of the first modular linear fireplace unit and positioned to close the open lateral end portion of the firebox of the first modular linear fireplace unit. The first end portion of the first modular end unit has a common configuration so as to be interchangeably attachable to the first attachment end portion of the second modular linear fireplace unit. A second modular end unit has at least a second end portion connected to the second attachment end portion of the second modular linear fireplace unit and positioned to close the open lateral end portion of the firebox of the second modular linear fireplace unit. The second end portion of the second modular end unit has a common configuration so as to be interchangeably attachable to the second attachment end portion of the first modular linear fireplace unit. The first and second modular linear fireplace units are coupled together to provide a continuous elongate firebox area therethrough.

DETAILED DESCRIPTION

The present disclosure describes a modular, linear gas-burning fireplace system, assemblies, and related components in accordance with embodiments of the present technology. Several specific details of the invention are set forth in the following description and the Figures to provide a thorough understanding of certain embodiments of the technology. One skilled in the art, however, will understand that the present technology may have additional embodiments, and that other embodiments of the technology may be practiced without several of the specific features described below.

Figure 1:
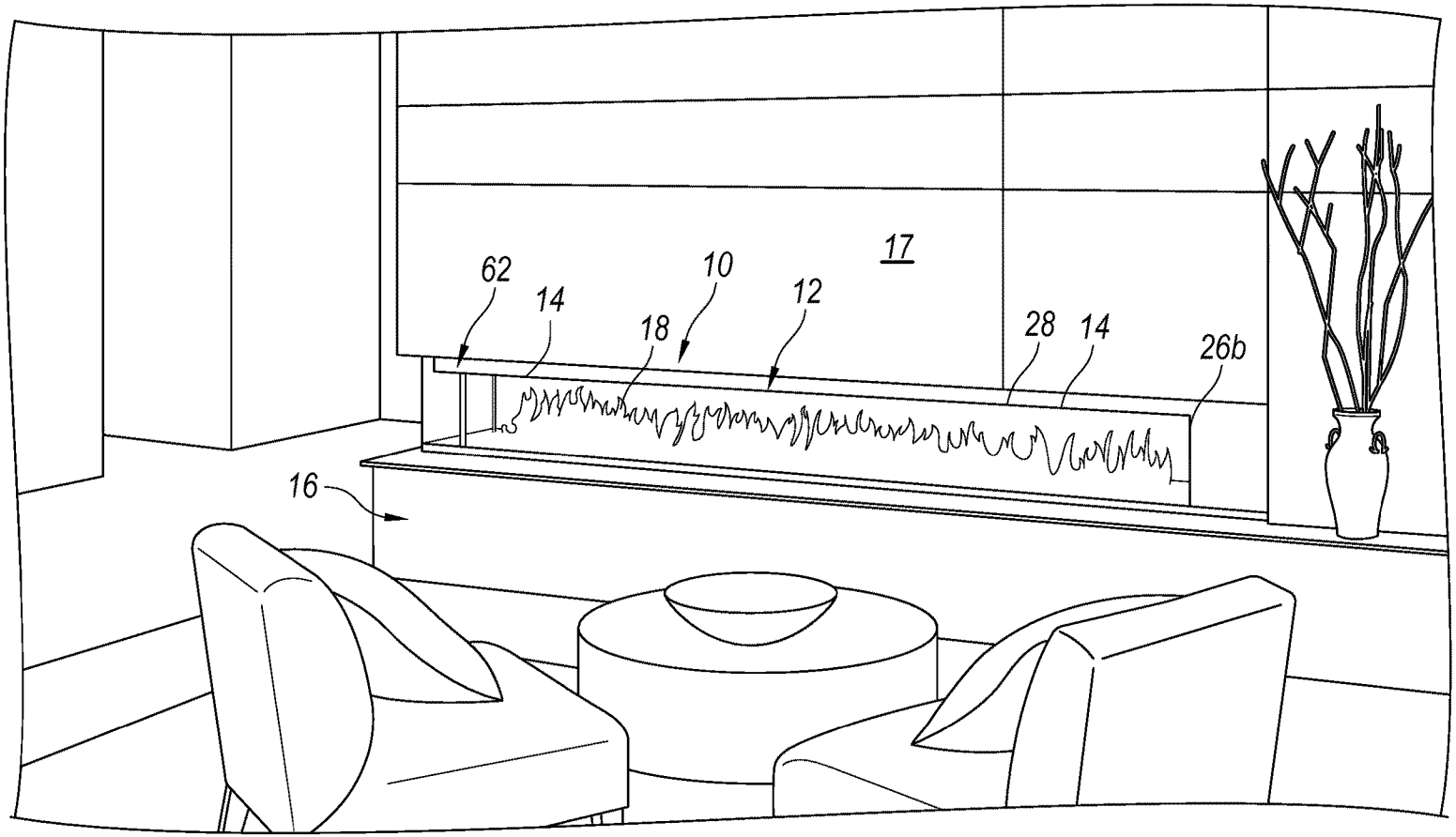
FIG. 1 is an isometric view of a multi-segment, modular linear fireplace assembly of one embodiment of the modular, linear fireplace system in accordance with an embodiment of the present technology.

FIG. 1 is an isometric view of a multi-unit, modular linear fireplace assembly 10 in one embodiment of the modular linear fireplace system 12 in accordance with an embodiment of the present technology. The illustrated modular linear fireplace assembly 10 is shown with a plurality of modular units 14 arranged in a straight-line, single-side configuration in an installation that includes non-combustible finish materials 16 and combustible finish building materials 17 mounted on or immediately adjacent to the fireplace assembly 10. The illustrated modular linear fireplace assembly 10 is a multi-segmented, direct vent gas-burning fireplace configured to burn natural gas, propane or other selected fuel gas within an elongated firebox 18.

Figure 2:
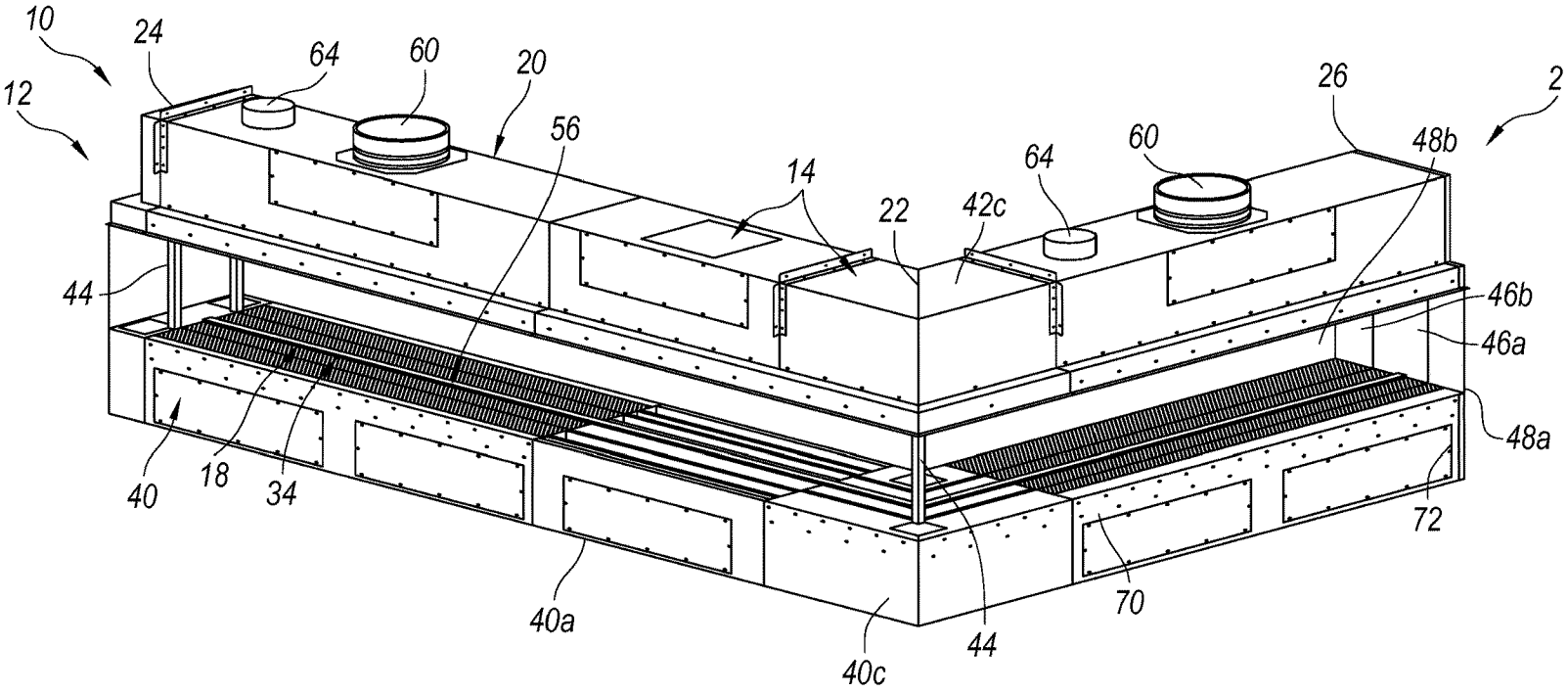
FIG. 2 is an isometric view of modular units of the system of FIG. 1 arranged in a linear fireplace assembly with an L-shaped, see-through configuration.
Figure 3:
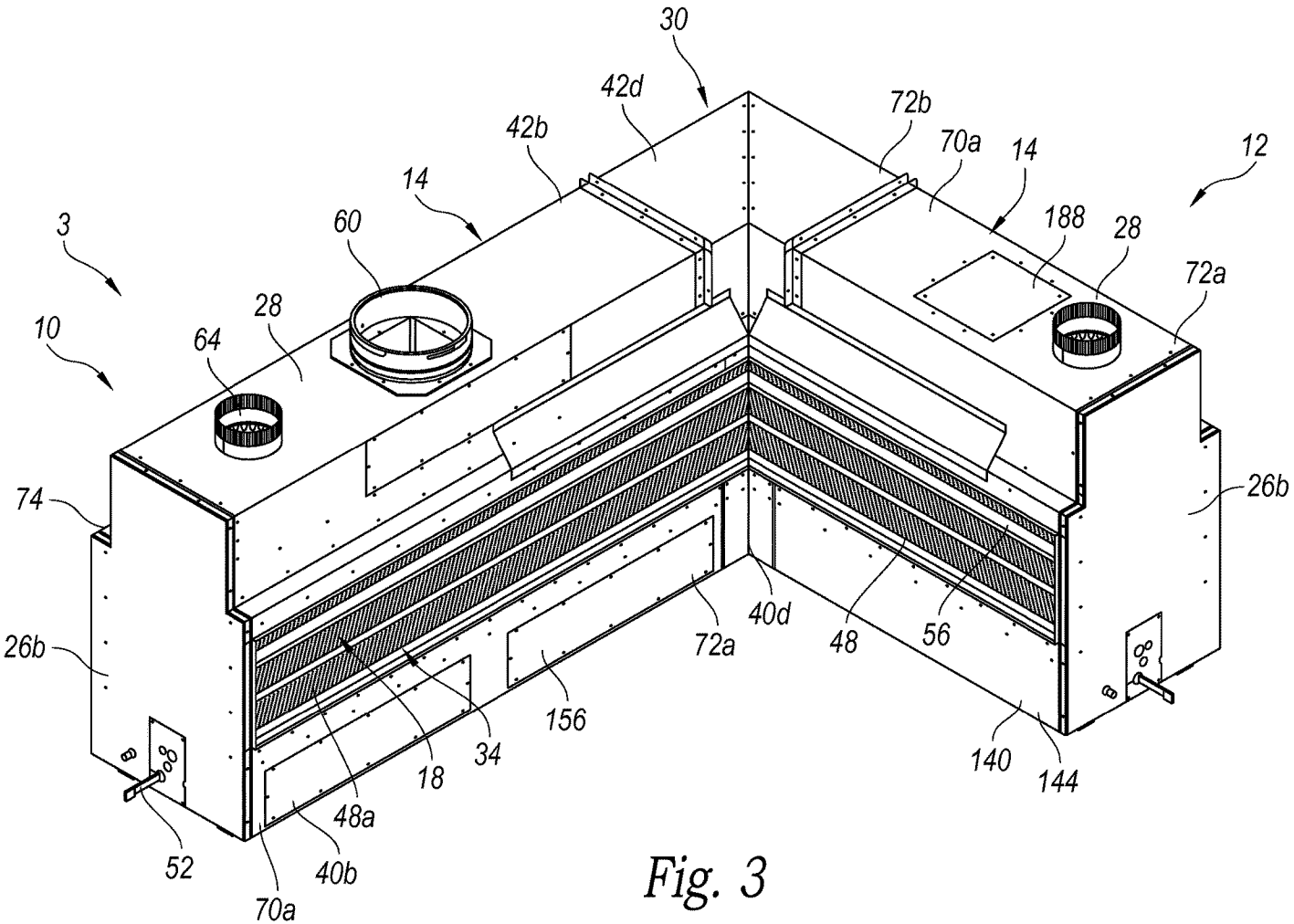
FIG. 3 is an isometric view of modular units of the system of FIG. 1 arranged in linear fireplace assembly with an L-shaped, single-side configuration.
Figure 4:
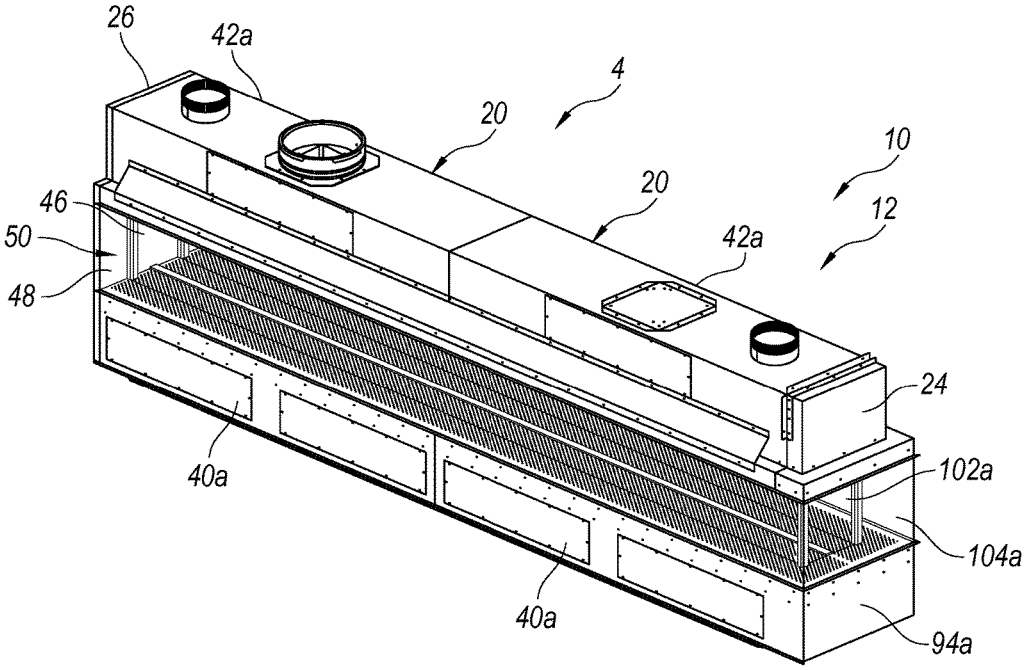
FIG. 4 is an isometric view of modular units of the system of FIG. 1 arranged in a linear fireplace assembly having a straight, see-through configuration with a see-through end cap on one end and a closure end panel on the opposite end.
Figure 5:
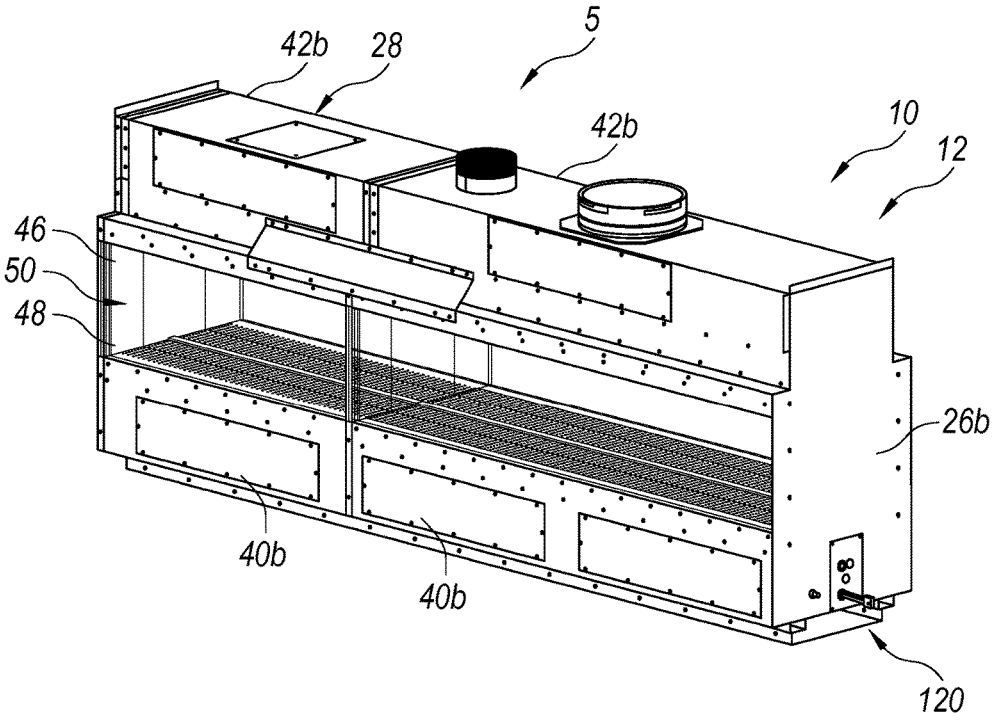
FIG. 5 is an isometric view of modular units of the system of FIG. 1 arranged in a linear fireplace assembly having a straight, single-side configuration with closed end panels.

The system 12 includes a plurality of modular units 14 of different configurations that can be interconnected in a wide variety of arrangements to achieve very aesthetically pleasing linear fireplace installations of different sizes or dimensions while avoiding the significant drawbacks experienced by conventional large customized linear fireplace installations. FIG. 2 is an isometric view of an L-shaped assembly 2 having modular, see-through linear fireplace units 20 connected to a see-through corner unit 22, a see-through end cap 24, and an end closure panel 26*a*, which are discussed in greater detail below. FIG. 3 is an isometric view of an L-shaped assembly 3 having modular "single-side" (i.e., a single viewing side and not fully see-through) linear fireplace units 28 with different lengths connected to a single-side corner unit 30 and single-side end closure panels 26*b*. FIG. 4 is an isometric view of a straight-line assembly 4 having see-through linear fireplace units 20 connected to a see-through end cap 24 and a single-side end closure panel 26*a*. FIG. 5 is an isometric view of a straight-line assembly 5 having single-side linear fireplace units 28 of different lengths connected to single-side end closure panels 26*b*. Referring again to FIG. 1, the figure illustrates yet another arrangement of modular single-side linear units 28, a single-side end cap 32, and a single-side end closure panel 26*b*. These assemblies are only a few examples of arrangements that can be created with the linear units 20/28, the corner units 22/30, and end caps 24/32 of the system 12 in accordance with the present disclosure.

The plurality of modular units of the linear fireplace system 12 are interchangeably interconnectable to allow a designer, architect, builder, etc., to create a beautiful linear fireplace in any one of an expansive variety of arrangements for a selected installation. In one embodiment, the modular units have one or more connector end portions with a common interface construction, such that the connector end portion of one module can be securely and fixedly attached to a connector end portion of any other module of the assembly. Such a construction allows for very flexible interchangeability of modules to create many different linear fireplace assembly configurations. The modular units are also configured so they can be easily and quickly assembled on site at the installation location while avoiding the problems experienced in the prior art with transporting and installing pre-built custom fireplaces in remote installations. As a result, the system 12 can be significantly easier and less expensive to incorporate into an installation, either in new construction or in connection with a remodel of an existing structure.

In the illustrated embodiments, the system 12 has a plurality of linear fireplace units 20 of selected lengths. For example, the system 12 includes the see-through linear fireplace units 20 and single-side linear fireplace units 28 in 5-foot, 4-foot, and 3-foot lengths. In another embodiments, the system 12 can include the linear fireplace units 20/28 in other lengths, including but not limited to 7-foot, 5-foot, 3-foot, and/or 1-foot lengths. In addition, the see-through and single-side corner units 22 and 30 of the illustrated embodiment are arranged in a 90-degree corner configuration. Other embodiments can include see-through and/or single-side corner units arranged with different angular orientations, including but not limited to 30-degree, 45-degree, and/or a 60-degree corner arrangements. In yet other embodiments, the system 12 can include arcuate corner units (see-through or single-side) attachable to the linear units, the end cap units, or even to other corner units. The corner units 22 and 30 can also be provided in different lengths.

The system 12 of the illustrated embodiment also includes linear units 20/28, corner units 22/30, end caps 24/32, and closure panels 26*a/b* of different heights to provide taller or shorter viewing areas 34 into the firebox 18 in which the fire is contained. For example, the linear units 20/28, corner units 22/30, end caps 24/32, and closure panels 26*a/b* of the illustrated embodiment are provided with support frames and glass panels, discussed in greater detail below, configure to provide for 12-inch and 20-inch high viewing areas 34 into the fireboxes 18. In other embodiments, the system can provide modular units with viewing areas 34 of different heights.

As indicated above, the system 12 includes multiple linear fireplace units 20/28, corner units 22/30, and end caps 24/32. Each of these modular units includes a base portion 40 and a top portion 42 separated by support frames 44 and a plurality of glass panels 46 that act to define the height of the firebox 18 and associated viewing area. FIG. 6 is an isometric view of the modular, see-through linear fireplace unit 20 of at least one embodiment. The illustrated linear unit 20 has a construction for use in an installation where people can see into the firebox 18 from the front and rear sides of the assembly 10. The see-through linear unit 20 has a base portion 40*a* spaced apart from a top portion 42*a* by support frames 44*a*, and a plurality of interior glass panels 46 and exterior glass panels 48. The firebox 18 is formed between the base portion 40*a* and the top portion 42*a* and between a pair of the spaced apart interior glass panels 46*a*. The exterior glass panels 48*a* are spaced outwardly apart from the interior glass panels 46*a* to define an air gap 50 or passageway to further isolate the firebox 18 from the exterior glass panels 48*a*.

As discussed in greater detail below, the base portion 40 of the modular units contains gas lines 52 and fireplace control units 54 that are operatively connected to an elongated burner assembly 56 positioned at the bottom of the firebox 18. The gas lines 52 are coupleable to a fuel gas source, and the gas lines carry the fuel gas to multiple segments of the burner assembly 56. The fuel gas is ignited and burned in the firebox 18 above the burner assembly 56 and between the interior glass panels 46*a*.

This arrangement of interior and exterior glass panels 46*a* and 48*a* between the base and top portions 40*a* and 42*a* allows a substantially unobstructed view into the firebox 18 from either side of the linear unit 20. Accordingly, a viewer can see fully through the linear unit 20 and can see the flames in the firebox 18 from the front and rear sides of the see-through linear unit. The air gap 50 between the interior and exterior glass panels 46*a* and 48*a* provides an insulating space so the exterior glass panels 48*a* are not directly exposed to the flames in the firebox 18 and its associated heat.

The top portion 42*a* of the see-through linear unit 20 has an interior exhaust chamber 58 directly above and in direct communication with the firebox 18. The exhaust chamber 58 is connected to an exhaust flue 60 that connects to a contained chimney or other exhaust duct 62 (shown in phantom lines) to carry the combustion exhaust away from the firebox 18 without entering the room in which the fireplace assembly 10 is installed. In at least one embodiment, the exhaust chamber 58 and/or the exhaust duct 62 can include a powered fan 63 (shown schematically in phantom lines) configured to facilitate the exhaust flow away from the firebox 18 and the exhaust chamber 58. This powered exhaust configuration can include one or more fans with selected air flow capacities depending upon the size and configuration of the assembly and the amount of exhaust generated during operation.

The top portion 42*a* also has a combustion air intake flue 64 that connects to an exterior combustion air duct 65 or other fresh air source. As discussed in greater detail below, the combustion air intake flue 64 is connected to a combustion air chamber 66 in the top portion 42*a* that provides the fresh combustion air to a combustion air passage 68 in communication with the firebox 18 adjacent to the burner assembly 56, thereby providing a flow of fresh combustion air that will facilitate the burning of the fuel gas in the firebox 18 with the fuel gas.

Figure 6A:
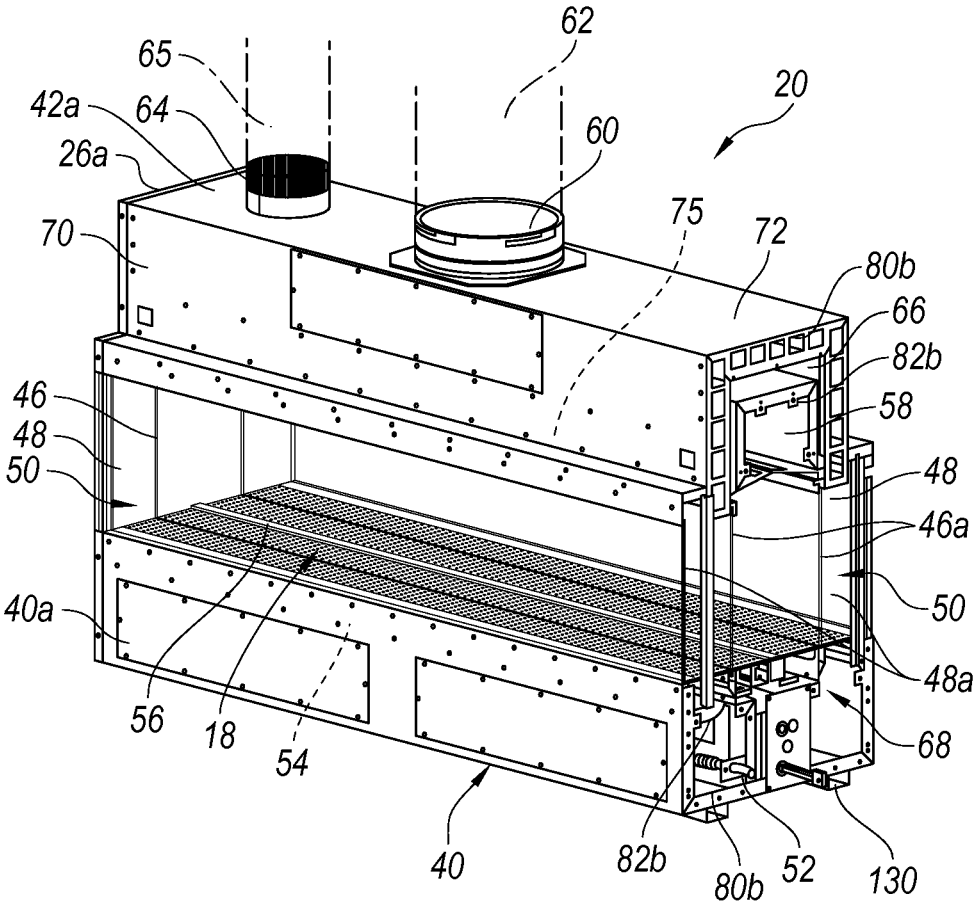
FIG. 6A is an isometric view of a modular linear fireplace unit of the system of FIG. 1, wherein the unit is shown in a see-through configuration.

From the perspective of viewing the see-through linear unit 20 as shown in FIG. 6A, the see-through linear unit 20 has left and right connector end portions 70 and 72, respectively, having commonly arranged structure (e.g., flat connection flanges, tabs, brace plates, and/or associated fasteners) that mates with and can be fastened to similarly configured mating structure (e.g., flanges, tabs, brace plates, and/or associated fasteners) of another see-through linear unit 20, and/or a see-through end cap 24, and/or a see-through corner unit 22, and/or an end closure panel 26*a*. In the illustrated embodiment, the left end portion 70 is shown connected to an end closure panel 26*a* that fully closes the left end of the see-through unit 20, and the right end portion 72 is arranged to be securely connected with another selected mating module of the system 12 for a see-through linear fireplace assembly. The configuration of the connector end portions provides a butt joint between the modules, wherein the modules are fastened to each other at the base and/or top portions 40*a* and 42*a*. Accordingly, the glass panels of adjacent modules are securely retained in a tight butt joint with no joining structure needed in the firebox for the adjacent abutted glass panels.

Figure 6B:
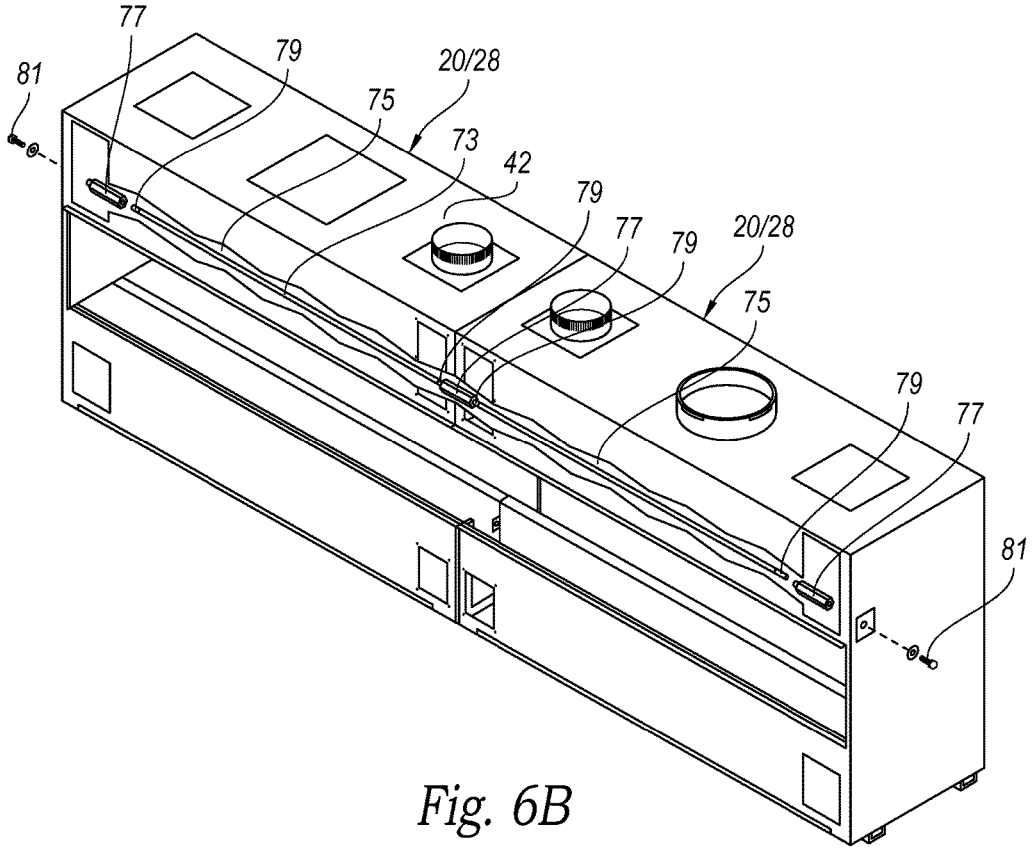
FIG. 6B is a partially cutaway and partially exploded isometric view of two modular units of an embodiment arranged in a straight line configuration and showing a torsion bar assembly of spanning between the two units.

FIG. 6B is a partially cutaway and partially exploded isometric view of two linear units 20/28 of an embodiment interconnected in a straight line configuration, and a torsion bar assembly 71 spans between the two units. In some embodiments, two or more linear units 20/28 may be so long that additional support is needed to protect against the units' top portions 42 from sagging or drooping across the span, which could cause misalignment between adjacent units. The torsion bar assembly 71 is configured to span across two or more adjacent linear units 20-28 and to provide such support to maintain alignment and prevent unwanted sagging or drooping. In the illustrated embodiment, the torsion bar assembly 71 includes one or more torsion rods 73 positioned in aligned elongated channels 75 extending through the top portions 42, such that the one or more torsion rods 73 span substantially across the length of the adjacent linear units 20/28. The one or more torsion rods 73 are connected to one or more adjustment members 75 configured to tightened and pull on the torsion rod(s) 73 to put the rod(s) in tension. Alternatively the adjustment members 75 may be loosened to reduce the tension in the torsion rod(s) 73.

In the embodiment illustrated in FIG. 6B, the torsion rod assembly 71 includes a pair of interconnected torsion rods 73 spanning through and between two adjacent linear units 20/28. At least the ends 79 of each torsion rod 73 are threaded, and each threaded end 79 screws into a threaded aperture of an adjustment devices 75, such as an elongated hex-nut or the like. In the illustrated embodiment, adjacent torsion rods 73 are interconnected by a central hex-nut or other adjustment device 75 that has two opposing threaded apertures. The adjustment devices 75 connected to the left and/or right ends of the torsion rods 73 can be rotatably anchored to the top portion 42 by threaded anchors 81. The top portion 42 of each of the linear unit 20/28 has apertures that provide access to the end and/or middle adjustment devices 75 that allows a person to engage and rotate the adjustment devices to tighten or loosen the torsion rods 73, such as during the installation procedure. Accordingly, the torsion bar assembly 71 allows for the use of longer linear units 20/28 while avoiding difficulties with misalignment, sag, and/or droop.

Figure 7:
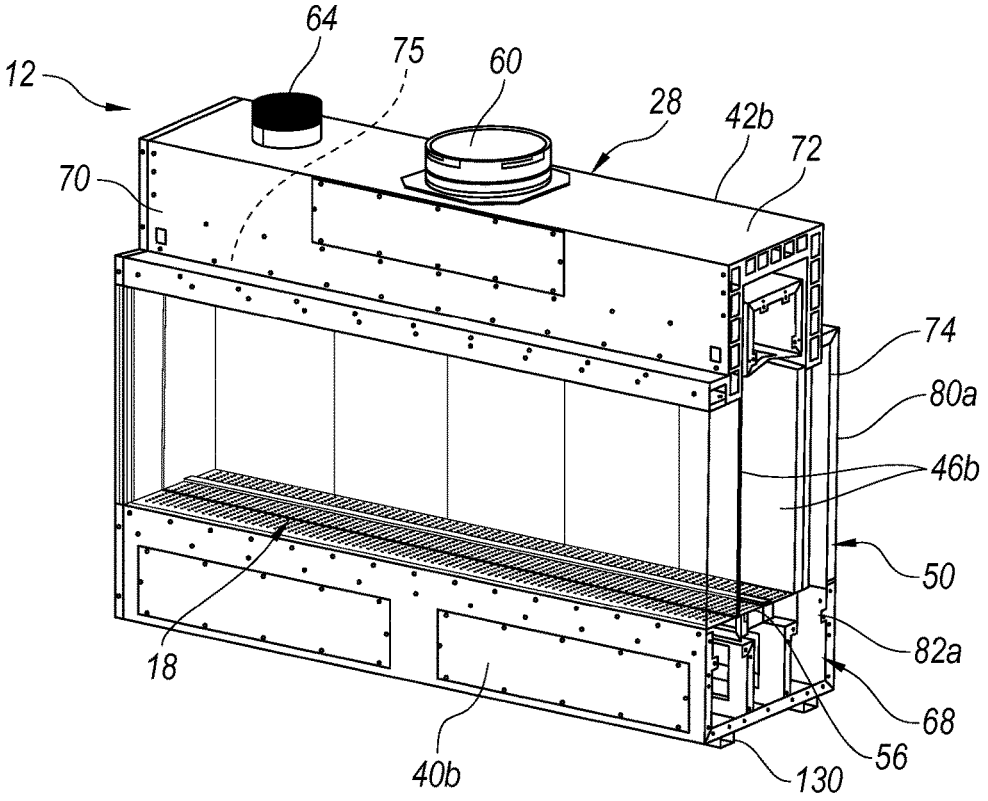
FIG. 7 is an isometric view of a modular linear fireplace unit of the system of FIG. 1, wherein the unit is shown in a single-side configuration.

FIG. 7 is an isometric view of a single-side linear fireplace unit 28 of an embodiment of the system 12. The single-side linear unit 28 has a configuration for use in an installation wherein people will only be viewing the unit from one longitudinal side of the fireplace assembly (i.e., from the front side). The single-side linear unit 28 has a construction very similar to the see-through linear unit 20 discussed above regarding FIG. 6 (so it need not be repeated), except along the rear side of the unit. The single-side linear unit 28 has the firebox 18 defined by interior front glass panels 46 spaced apart from an interior rear panel 46*d*. The interior rear panel 46*d* can be a transparent, translucent, or opaque panel. In one embodiment, the interior rear panel 46*d* is a glass panel similar to the interior front panel 46*b*. The rear side of the unit 28 includes a substantially opaque or translucent rear closure panel 74 generally parallel to and spaced apart from the rear interior glass panel 46*d*. The rear closure panel 74 is connected along its top and bottom edges to the units top portion 42*b* and the base portion 40*b*, respectively, to retain the closure panel 74 apart from the rear interior glass panel 46*b* while still providing an air gap 50 or passageway therebetween. Accordingly, the single-side linear unit 28 is configured so a viewer can see into the firebox 18 and see the flames therein during operation of the unit, but at least the rear closure panel 74 blocks the viewer from seeing fully through the unit past the unit's rear side.

In at least one embodiment, the interior rear panel 46*d* can be a single panel or a plurality of aligned modular panel sections 46*d*'. In another embodiment, the closure panel 74 can be formed by a plurality of panel sections. The panel sections can be decorative panel sections made of one or more selected suitable materials, such as metal, opaque glass, or the like, with a selected color, texture, image, or decorative pattern. The panel sections can be provided with a uniform construction so as to be interchangeable. Accordingly, a user or manufacturer can provide assemblies 10 with the firebox areas having different aesthetic appearances by using different panel segment that can be easily and quickly installed during the original installation or during a retrofit for maintenance procedure.

In the illustrated embodiment of the single-side linear unit 28, the rear sides of the base and top portions 40*b* and 42*b* are configured to connect to the rear closure panel 74 so the lateral distance between the closure panel 74 and the rear interior glass panel 46 can be less than the distance between the rear interior and exterior glass panels 48 and 48 of the see-through linear unit 20 discussed above, while still maintaining substantially the same performance and visual presentation of the flames in the firebox 18.

Figure 8A:
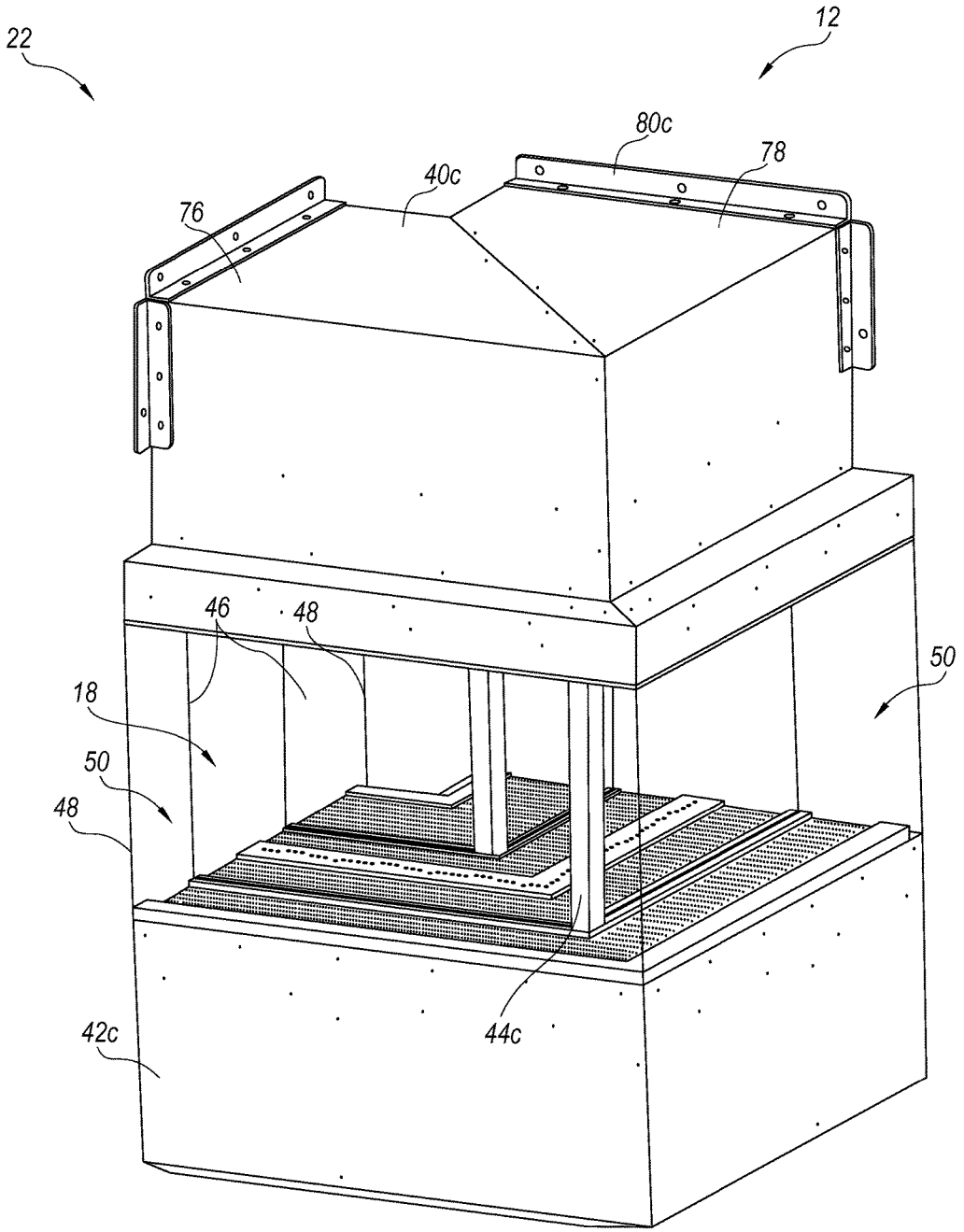
FIGS. 8A and 8B are front and rear isometric views of a corner unit of the system of FIG. 1, wherein the corner unit is shown in a see-through configuration.
Figure 8B:
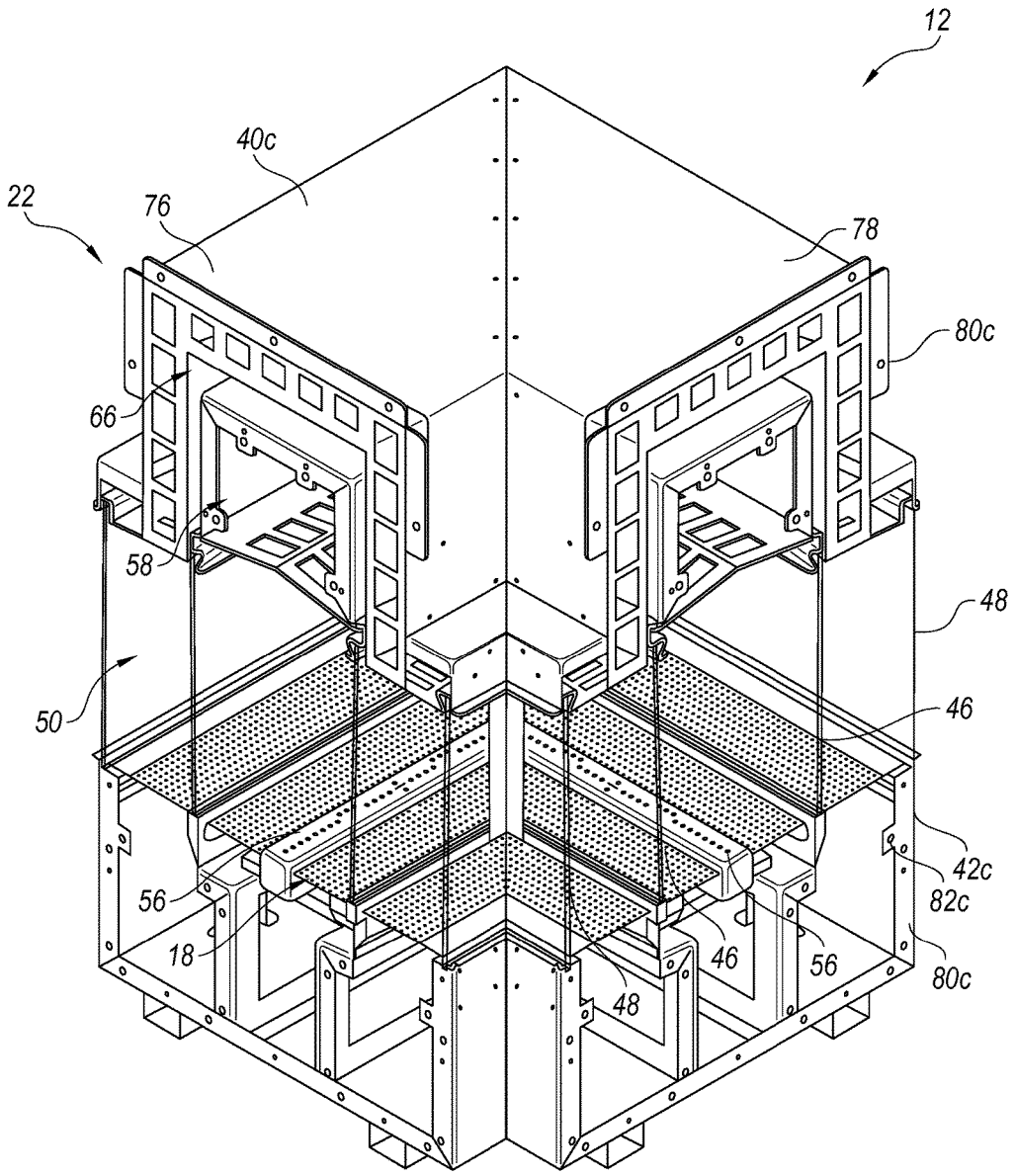

The system 12 includes modular corner units configured to connect to the linear fireplace units, including the see-through linear units 20 and single-side linear units 28. The modular corner units are also configured to connect to the modular end caps, including the see-through end cap 24 and single-side end cap 26. FIGS. 8A and 8B are isometric views of a see-through corner unit 22 of an embodiment of the system 12. The corner unit 22 is a 90-degree corner unit having L-shaped base and top portions 40*c* and 42*c* spaced apart from each other by a support frame 44*c* and interior and exterior glass panels 46 and 48, respectively, to define the firebox 18 therebetween. The corner base portion 40*c* and the corner top portion 42*c* have structural configurations substantially similar to the base portion 40*a* and top portion 42*a* discussed above, except for the L-shape of the unit. The corner unit 22 has orthogonally oriented end portions 76 and 78 configured to mate with the respective left or right end portion 70 or 72 of the see-through linear unit 20 (FIG. 6) in a modular manner. The corner unit's end portions 76 and 78 are also configured to mate with a see-through end cap 24 and an end closure panel 26*a* in a modular manner.

As seen in FIGS. 8A and 8B, the base and top portions 40*c* and 42*c* of the see-through corner portion 22 have a plurality of flanges 80*a* and/or tabs 82*a* positioned to align with and be fastened to similar flanges 80*b* and/or tabs 82*b* on the end portions 70 and 72 of the see-through linear unit 20 (FIG. 6). The end caps 24 have similar arrangements of flanges and tabs that connect with the flanges 80*a/b* and tabs 82*a/b* of the corner and linear units 22 and 20, respectively, when joined together in a selected assembly. Accordingly, when the see-through corner unit 22 is attached to the see-through linear unit 20, the base portions 40*a*/40*c*, glass panels 46/48, and top portions 42*a*/42*c* are axially aligned and cleanly abut to provide an elongated, modular, substantially continuous burner assembly 56, firebox 18, exhaust chamber 58, combustion air chamber 66, and the air gaps 50 between the glass panels 46/48.

Figure 9:
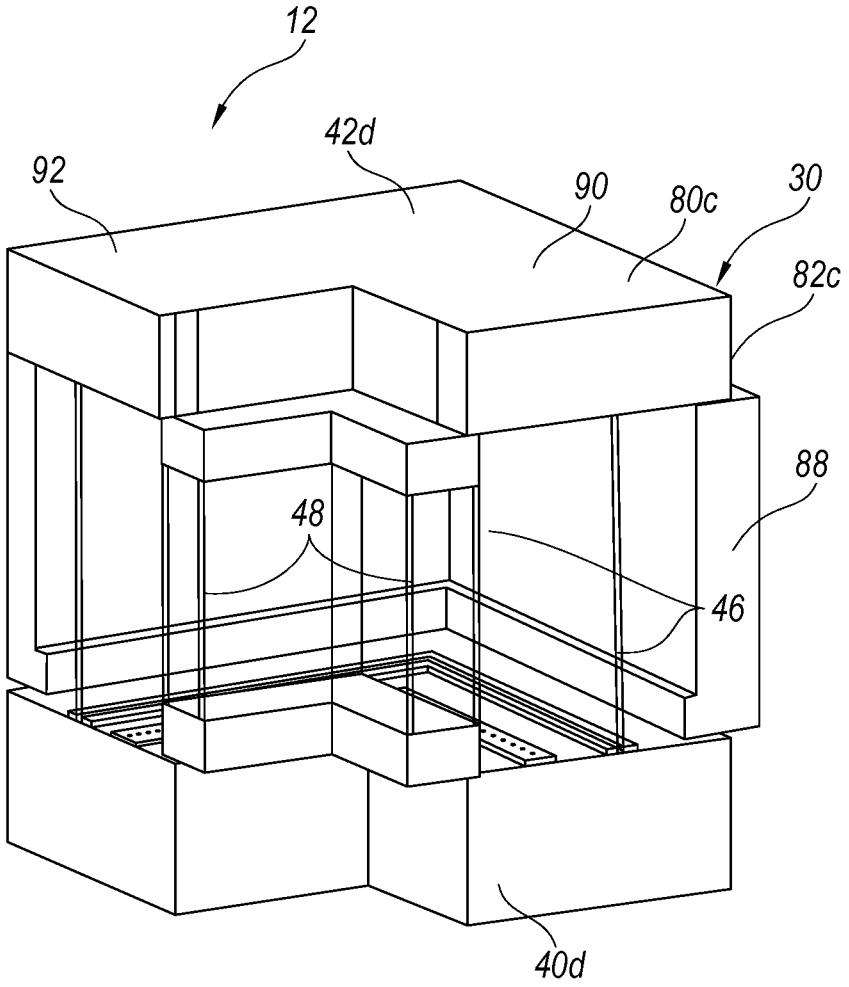
FIG. 9 is an isometric view of another corner unit of the system of FIG. 1, wherein the corner unit is shown in a single-side configuration.

FIG. 9 is an isometric view of the single-side corner unit 30 of an embodiment of the system 12. The single-side corner unit 30 is a 90-degree corner unit that has a construction similar to the see-through corner unit 22 described above, except along the rear side of the unit. Similar to the single-side linear unit 28, the rear side of the corner unit 30 includes an opaque or translucent rear closure panel 88 generally parallel to and spaced apart from the rear interior glass panels 46*c*. The single-side corner unit 30 has base and top portions 40*d* and 42*d*, respectively, having structural configurations substantially similar to the base and top portions 40*b* and 42*b* of the single-side linear unit 28 discussed above except for the L-shape of the unit. The corner unit's orthogonally oriented end portions 90 and 92 are configured to mate with the respective left or right end portions 70*b* and 72*b*, respectively, of the single-side linear unit 28 (FIG. 7) in a modular manner. The single-side corner unit's end portions 90 and 92 are also configured to mate with the single-side end cap 24 and the end closure panel 26*b* in a modular manner. The end portions 90 and 92 of the single-side corner unit 28 each have a plurality of flanges 80*c* and tabs 82*c* positioned to fasten to similar flanges 80*d* and tabs 82*d* on the end portions 70*b*/72*b* of the single-side linear unit 28 (FIG. 7). The single-side end cap 32 and closure end panel 26*b* have similar mounting structures that connect with the flanges 80*c/d* and tabs 82*c/d* of the single-side linear and corner units 28/30 when joined together in a selected assembly. Accordingly, when the single-side corner unit 30 is modularly attached to the single-side linear unit 28, the base portions 40*b/d*, glass panels 46/48, and top portions 42*b/d* are also axially aligned and cleanly abut to provide an elongated, modular, substantially continuous burner assembly 56, firebox 18, exhaust chamber 58, combustion air chamber 66, and the air gaps 50 between the glass panels 46/48.

Figure 10:
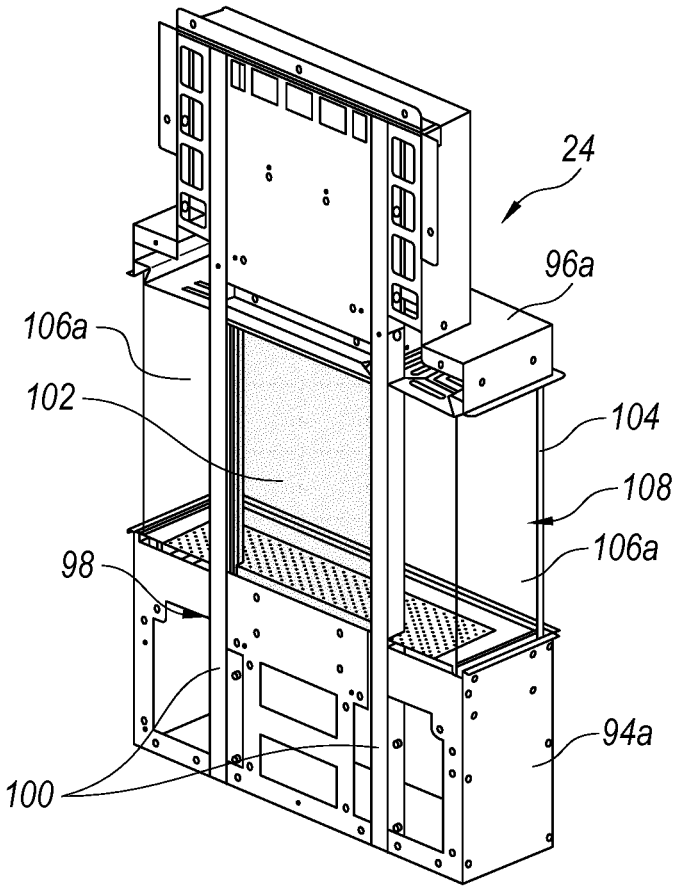
FIG. 10 is an isometric view of a see-through end cap unit of the system of FIG. 1.

FIG. 10 is an isometric view of the see-through end cap 24 of the system 12. The end cap 24 has a base portion 94*a*, a top portion 96*a*, and a support frame 98*a* extending therebetween. The base and top portions 94*a* and 96*a* are configured to attach to the ends of the base and top portions 40*a/c* and 42*a/c* of the see-through linear and corner units 20/22, thereby providing closure structure for the units. The top portion 96*a* is also configured to provide closure structure to the exhaust chamber 58 and the combustion air chamber 66 (FIG. 6) while keeping the chambers substantially isolated from each other to avoid mixing the outgoing exhaust and the incoming combustion air within the top portions of the units.

The support frame 98*a* of the illustrated embodiment has a pair of spaced apart vertical supports 100 positioned to be immediately adjacent to the ends of the interior glass panels 46 of the linear and corner units 20 and 22 (FIGS. 6 and 8B), respectively discussed above. The end cap 24 also has an interior glass end panel 102 spanning between the vertical supports 100 of the support frame 98*a*. The interior glass end panel 102 and vertical supports 100 provide a closure to the end of the firebox 18 of the linear unit 20 (FIG. 6) or the corner unit 22 (FIGS. 8A/8B) to which the end cap 24 may be attached. The end cap 24 also includes an exterior end glass panel 104*a* spanning between exterior side glass panels 106*a* to define an air gap 108*a* around the end of the firebox 18 (FIG. 6) of a selected assembly. The exterior side glass panels 106*a* are positioned to abut and align with the exterior glass panels 48 of the see-through linear units 20 (FIG. 6) and/or the see-through corner unit 22 (FIG. 8B) when the end cap 24 is attached to the mating modular components. In one embodiment, the exterior glass side panels 106*a* can be integral to the exterior glass panels of a mating linear or corner unit. Accordingly, a continuous space is provided around the firebox 18 of an assembly 10 between the interior and exterior glass panels 46/48/102/104/106 to isolate the firebox 18 from the outer surfaces of the fireplace assembly of a selected installation.

Figure 11A:
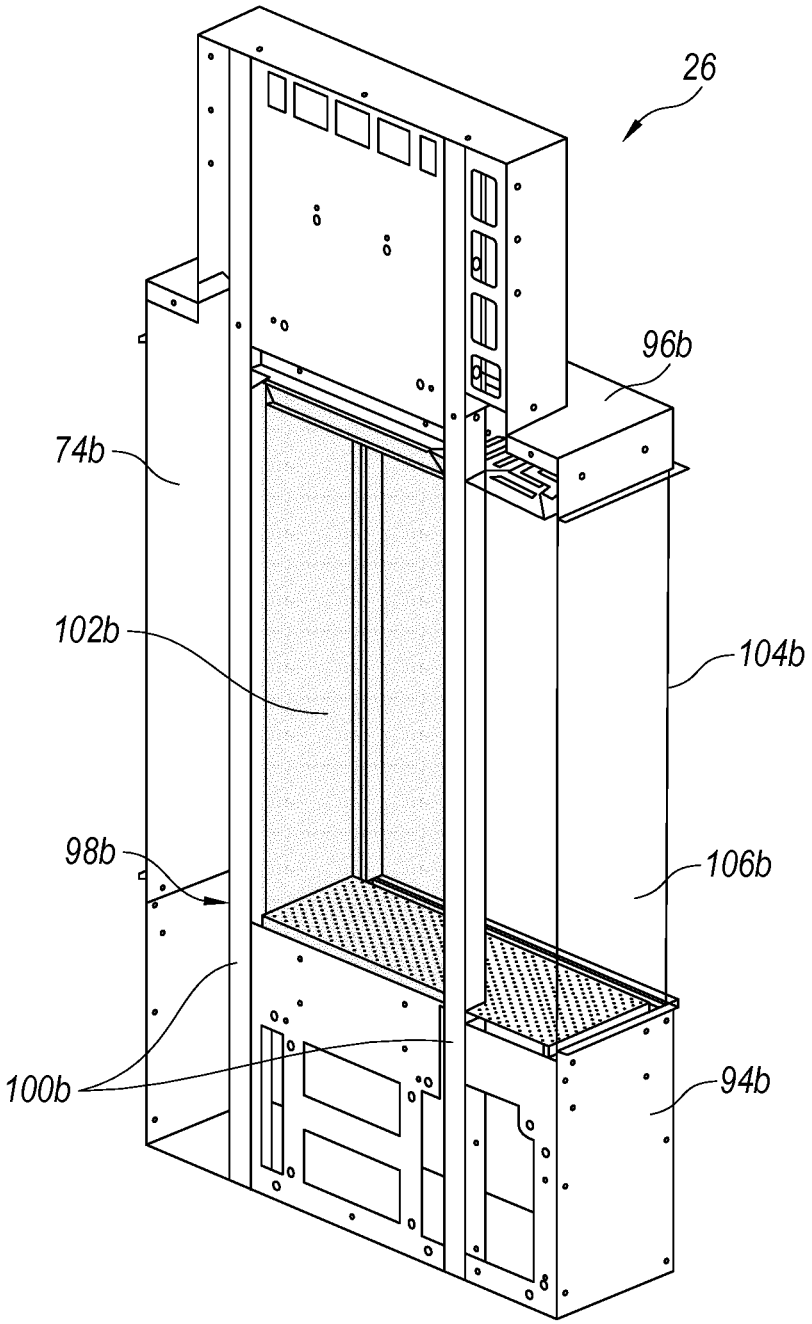
FIG. 11A is an isometric view of a single-side end cap unit of the system of FIG. 1.

FIG. 11 A is an isometric view of the single-side end cap 26 of the system 12. The single side end cap 26 has a base portion 94*b*, a top portion 96*b*, and support frame 98*b* generally similar to the see-through end cap 24 discussed above. The single-side end cap 26 also has an interior glass end panel 102*b* spanning between the vertical supports 100*b* of the support frame 98*b* that provides a closure to the end of the firebox 18 of the single-side linear unit 28 (FIG. 7) or the single-side corner unit 30 (FIG. 9) to which the end cap 26 may be attached. The end cap 26 has an exterior glass end panel 104*b* and an exterior glass side panel 106*b* similar to the see-through end cap 24, and the exterior rear wall is formed by an opaque or translucent rear closure panel 74*c* that abuts and aligns with the rear closure panel 74*a* or 74*b* of a single-side linear unit 28 (FIG. 7) and/or corner unit 30 (FIG. 9) when the units are interconnected. In one embodiment, the exterior glass side panel 106*b* can be integral to an exterior glass panel of a mating linear or corner unit. The single-side end cap 26 provides an end closure of the fireplace while allowing a person to see axially into the firebox 18 through the viewing space between the top and base portions 96*b* and 94*b*.

Figure 11B:
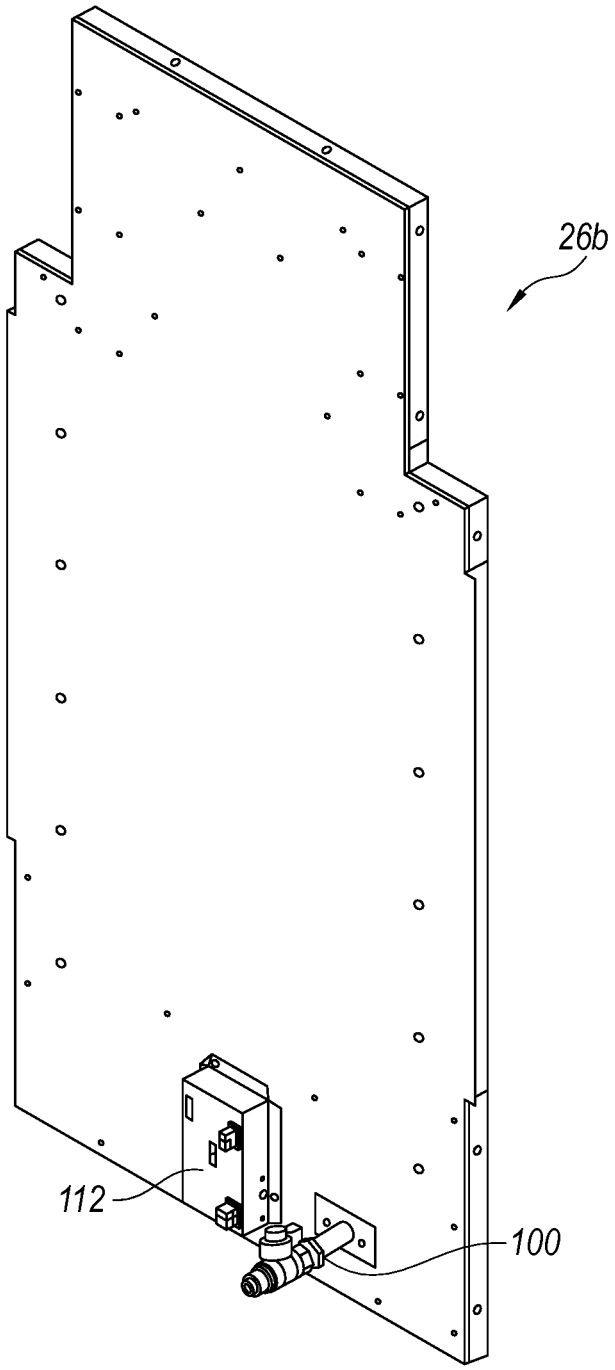
FIG. 11B is an isometric view of a panel end closure of the system of FIG. 1.

FIG. 11B is an isometric view of the end closure panel 26*b* for a single-side assembly. The end closure panel 26*b* is an opaque or translucent panel having a shape that mates with the end portions of the single-side linear unit 28 (FIG. 7) and/or the single-side corner unit 30 (FIG. 9) so as to fully close and seal the end of the unit to which the panel is attached. The end closure panel 26*a* for the see-through assembly has a similar structure but is shaped to mate with the end portions of the see-through linear unit 28 (FIG. 6) and/or the see-through corner unit 30 (FIG. 8B) so as to fully close and seal the end of the unit to which the panel is attached. The end closure panels 26*a* and 26*b* of the illustrated embodiment can include a gas line fittings 110 that communicates with the gas lines 52 in the linear or corner units discussed above to provide the fuel gas to the modular fireplace assembly 10. The end closure panels 26*a* and 26*b* can also include an electronic interface 112 that operably connects with the fireplace control units 54 of the selected linear and/or corner units 20/28 or 22/30, respectively, of the resulting modular linear fireplace assembly 10. Similar gas line fittings 110 and/or electronic interfaces 112 can be provided in the base portions 94*a/b* of the single-side end cap 26 or the see-through end cap 24 discussed above.

Figure 12:
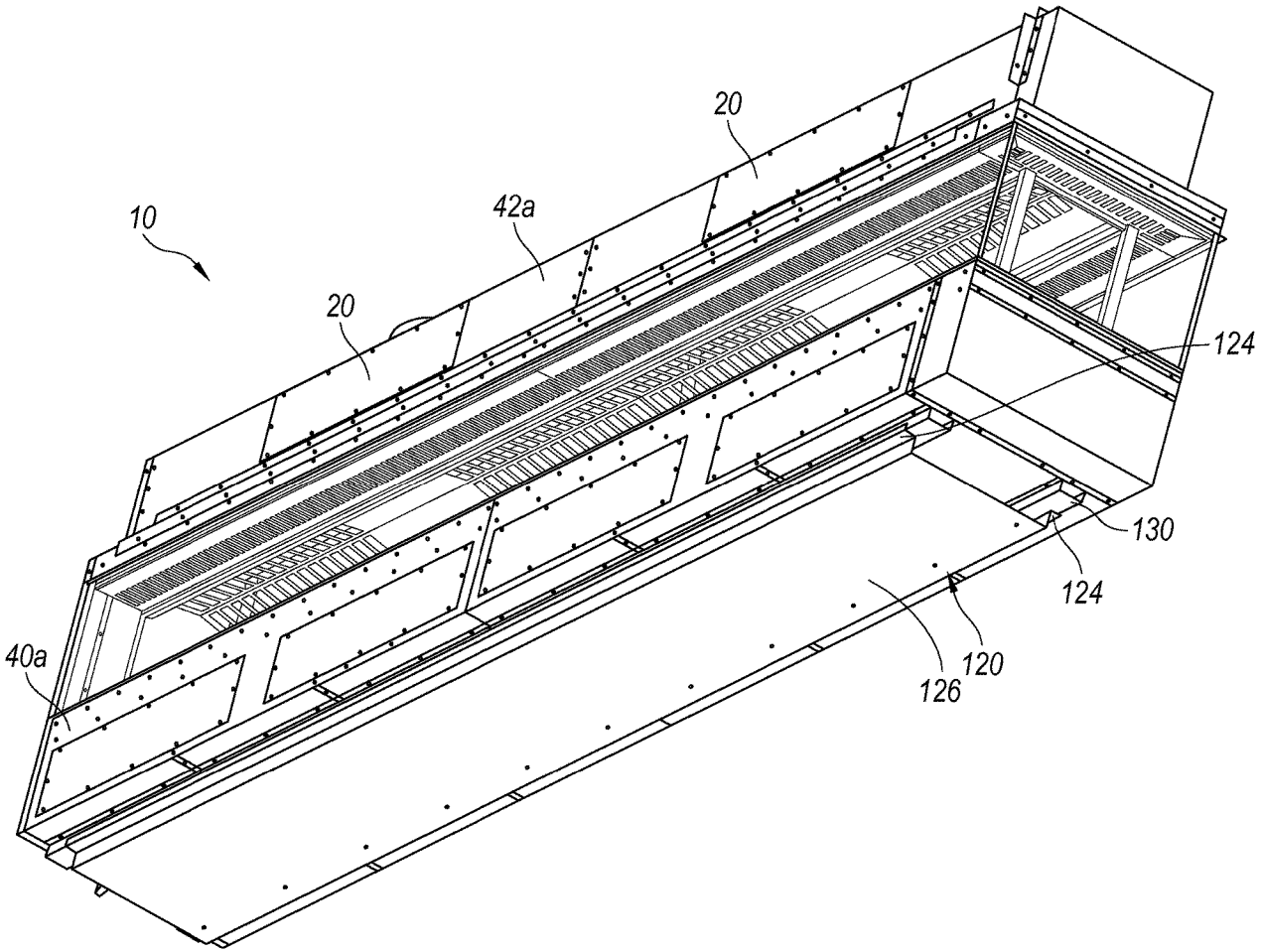
FIG. 12 is a bottom isometric view of the modular linear fireplace assembly of FIG. 4 showing an installation alignment system on the bottom of the modular units.

In the illustrated embodiment, at least the modular linear and corner units 20, 22, 28, 30 include an alignment track system 120 configured to allow for quick and easy axial alignment between adjacent interconnected modules during assembly of the units in a selected installation. This alignment track system 120 greatly increases the ease and accuracy of installing the modular units at the installation location during construction or a remodel, thereby decreasing the costs and labor intensity of installing the assembly 10 in a selected location. FIG. 12 is a bottom isometric view of the modular linear fireplace assembly 10 of FIG. 4 showing the alignment track system 120 on the bottom of the assembly. The alignment track system 120 includes an elongated track member 122 having a pair of parallel, spaced apart support tracks 124 interconnected by a planar mounting web 126. The track member 122 can be a unitary member or can be made of a plurality of interconnected segments to define the track member with a selected length. The track member 122 can include one or more support inserts 128 positioned on the web 126 between the support tracks 124 to provide structural support for the modular units inserted into the track, as discussed in greater detail below.

Figure 14:
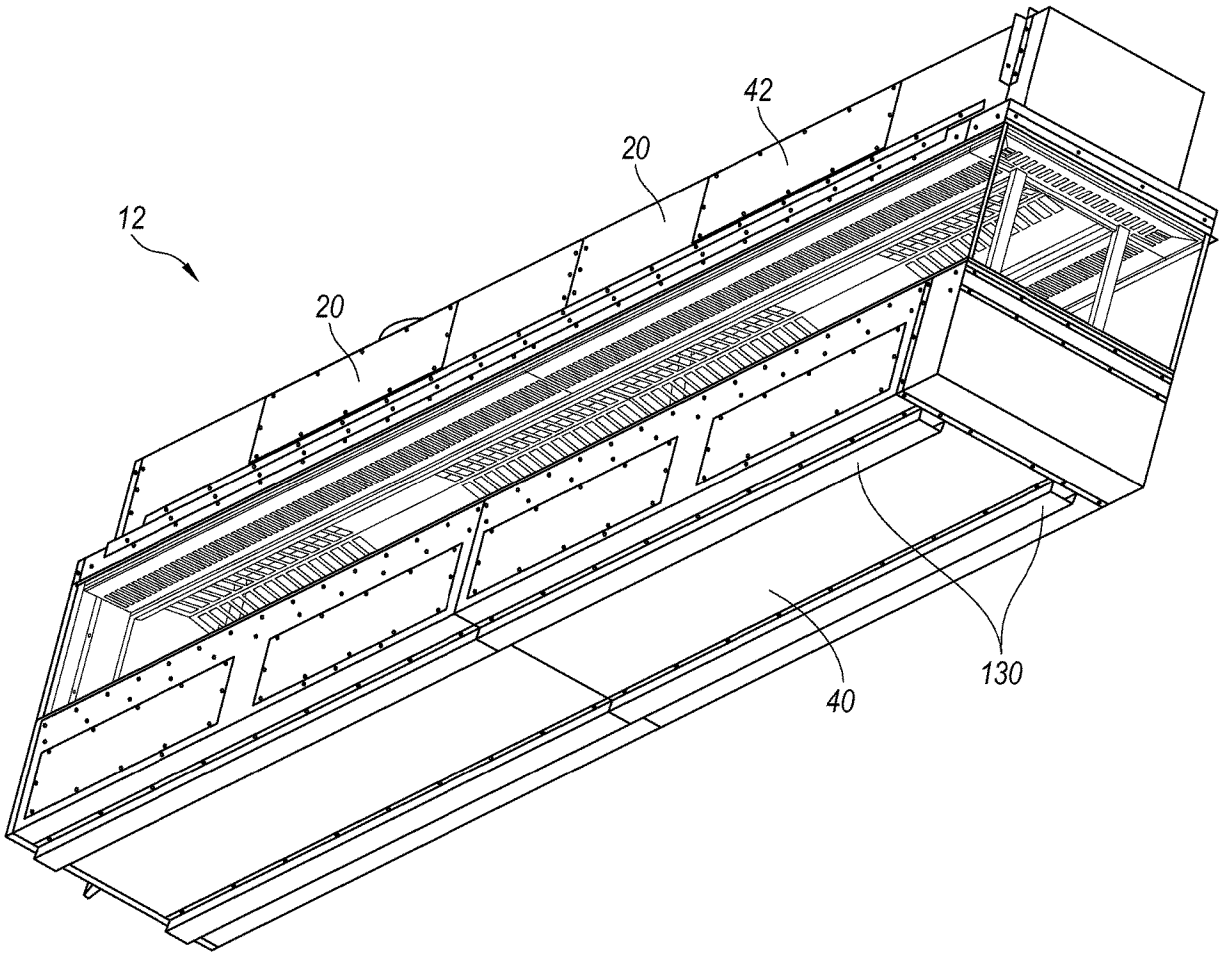
FIG. 14 is a bottom isometric view of the modular linear fireplace assembly FIG. 12 with the installation track member removed and showing the alignment rails on the base portions of the modular fireplace units.
Figure 16:
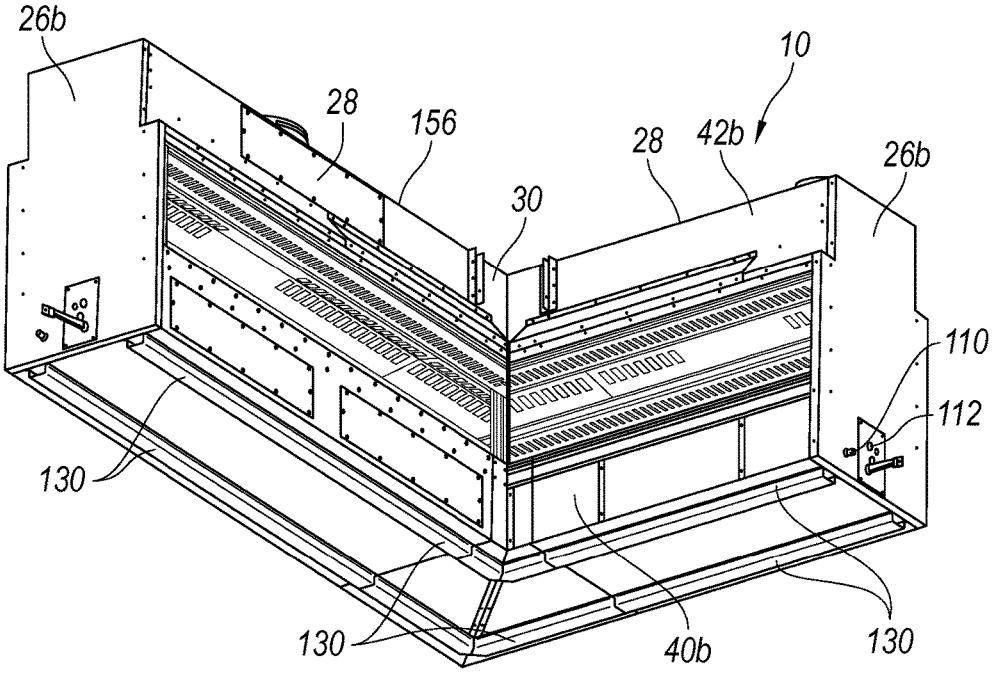
FIG. 16 is a bottom isometric view of the modular linear fireplace assembly of FIG. 3 with the installation track removed to show the alignment rail configuration on the bottom of the modular fireplace units.

As seen in FIGS. 12, 14, and 16, the base portion 40 of each modular linear or corner unit includes a pair of parallel alignment rails 130 spaced apart and positioned to fit within the track member 122 supported atop the support tracks 124 (FIG. 12). The alignment rails 130 are configured to properly position and coaxially align adjacent linear or corner modular units 20, 22, 28, 30 positioned in the track member 122, such that the adjacent modular units 20, 22, 28, 30 will be in the exact position to be interconnected during an assembly process. The track member 122 and alignment rails 130 also allow a modular unit to be placed on the support tracks 124 and then slid axially along the support tracks 124 to a final selected position during an assembly procedure, thereby greatly increasing the ease of moving and positioning the modular units during assembly at the installation site.

Figure 13:
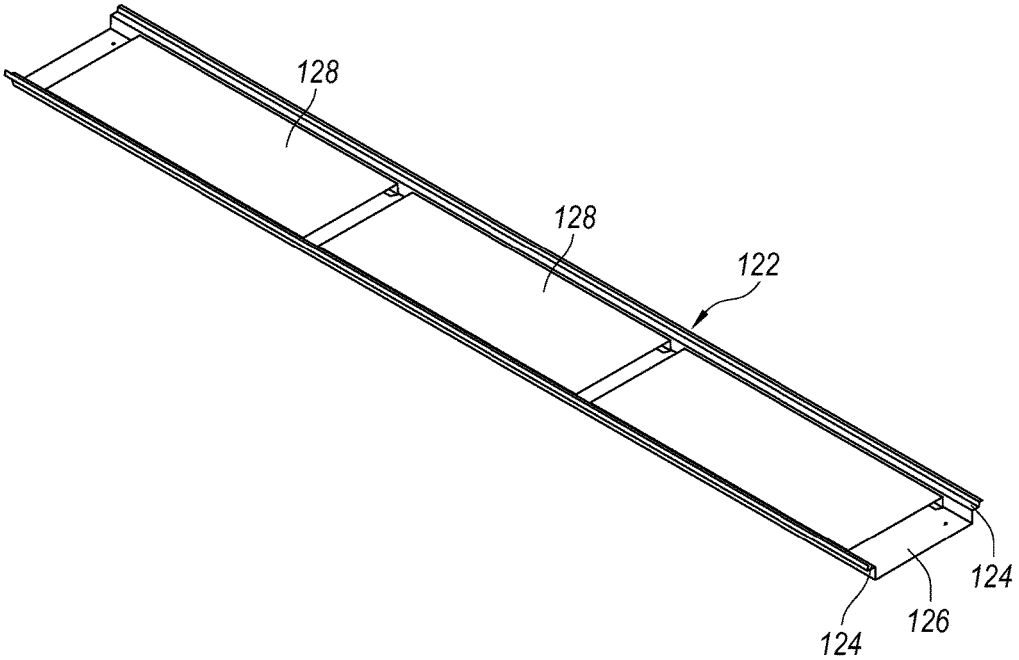
FIG. 13 is a top isometric view of an installation track member shown removed from the assembly of FIG. 12.

When a selected modular linear fireplace assembly 10 is assembled and installed at a selected site, the elongated track member 122 is mounted and secured in place on the selected building support structure that will support the fireplace assembly. In the illustrated embodiment, the track member 122 can be mounted using a plurality of fasteners that extend through the web 126 and/or through portions of the support tracks 124 that will not engage or otherwise interfere with the alignment rails 130 on the modular units. The support inserts 128 (FIG. 13) can be positioned on the track member 122 between the support tracks 124 in a location to help support or distribute the weight of the modular units of the linear fireplace assembly 10. The track member 122 can be arranged in a straight line configuration, or an L-shaped configuration or other configuration to match the layout of the interconnected modules of the selected linear fireplace assembly 10.

Figure 15:
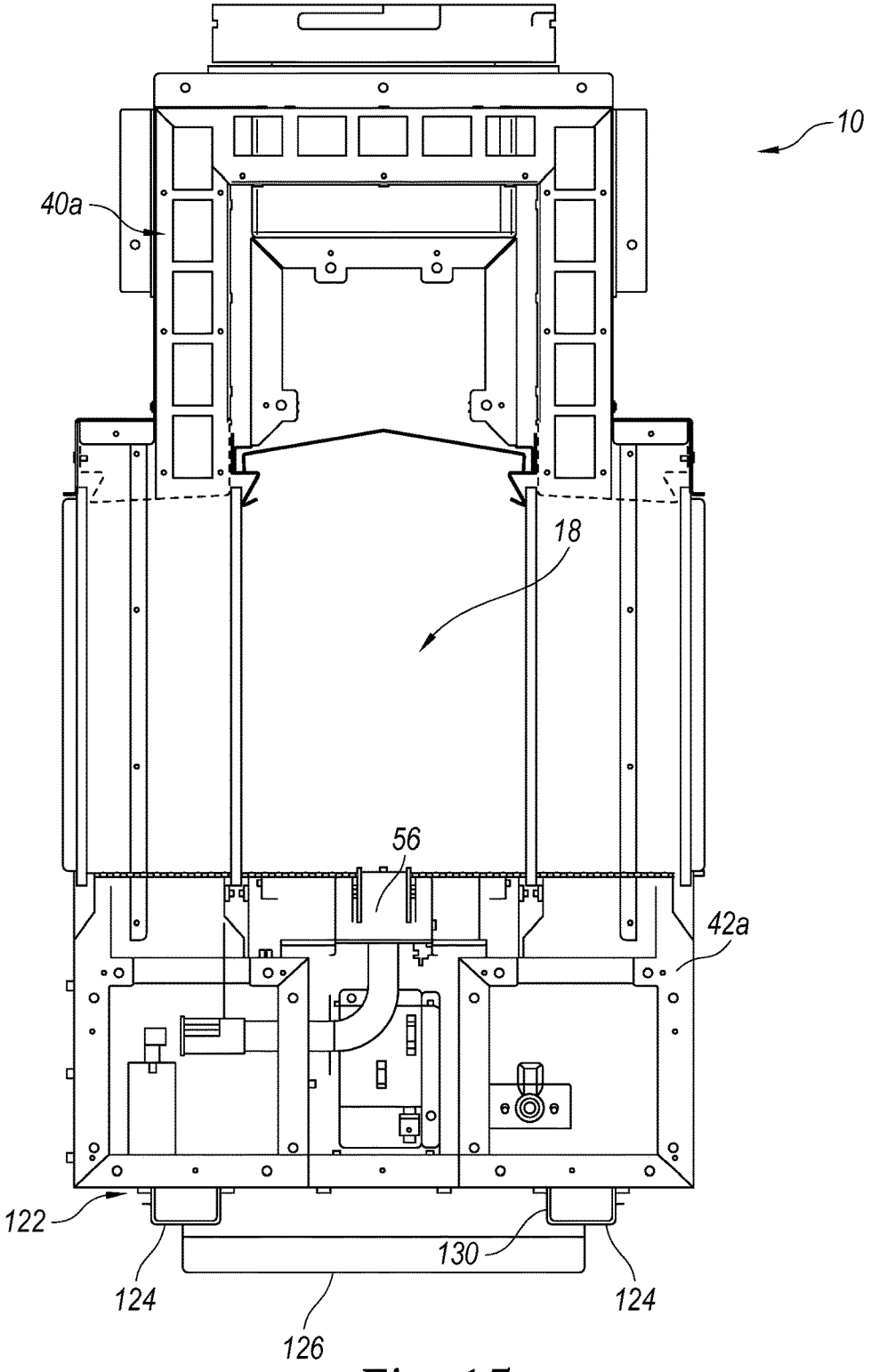
FIG. 15 is a cross-sectional view taken substantially along lines 15-15 of FIG. 14 showing the interface between the installation track member and the alignment rails on the bottom of the modular fireplace units.

After the track member 122 is installed, a first modular fireplace unit 20, 22, 28, 30 can be positioned on the track member 122 with the alignment rails 130 in engagement with the support tracks 124, as shown in FIG. 15. The installed modular unit can then be axially positioned along the track member 122 to a final or other desired location. Then a second modular unit 20, 22, 28, 30, such as a linear or corner unit, can be positioned in the track member 122 with its alignment rails 130 engaging the support tracks 124, and the second modular unit adjusted axially to abut the end portion of the first modular unit. Accordingly, the track member 122 spans across the abutting joint between the adjacent linear fireplace modules. The interface between the support tracks 124 and alignment rails 130 insures proper axial alignment of the abutting modular units. The additional modular units can be placed on the track member 122 and joined or otherwise secured to the other modular units in accordance with the arrangement of the selected assembly 10. The end caps 24, 26 or end closure panels 26 can also be installed and fastened in place on their respective adjacent modular units to enclose the ends of the selected modular assembly 10.

Figure 17:
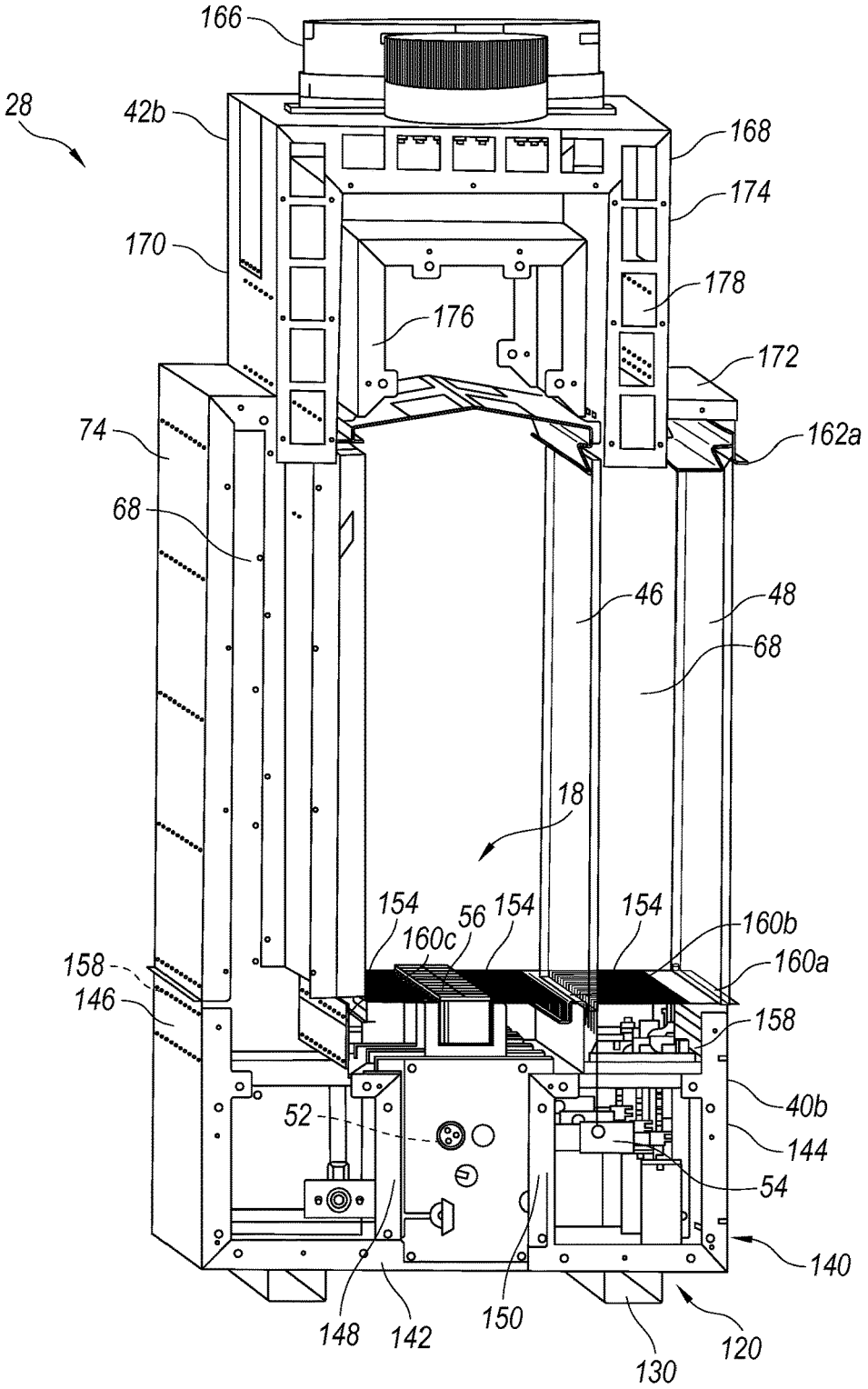
FIG. 17 is a cross-sectional isometric view taken substantially along line 17-17 of the modular fireplace unit of FIG. 6.
Figure 18:
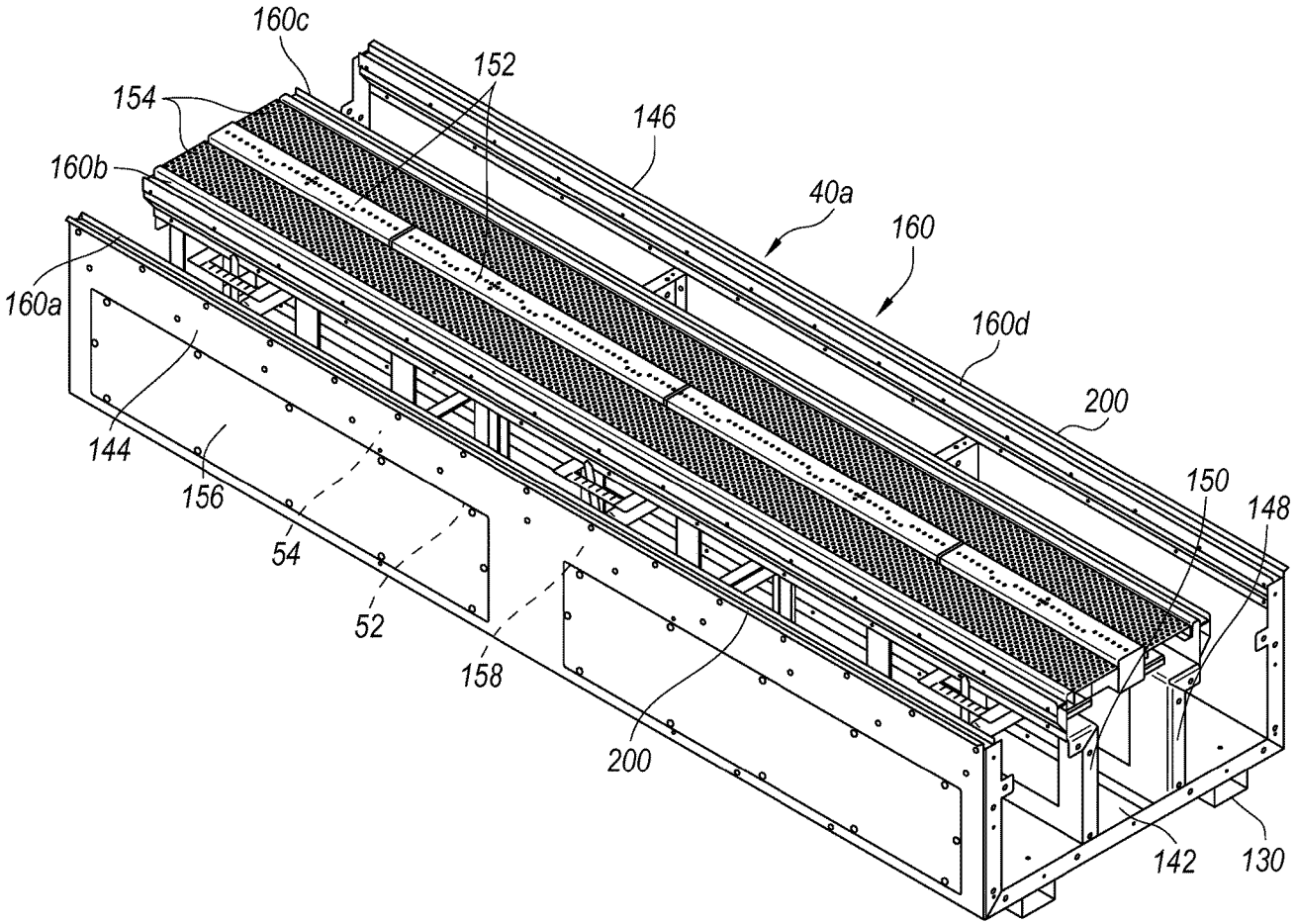
FIG. 18 is a top isometric view of a base portion of the modular fireplace unit of FIG. 6.

FIG. 17 is a cross-sectional isometric view showing a single-side linear unit 28 of an embodiment, and FIG. 18 is a top isometric view of the base portion 40*a* of the see-through linear unit 20. The base portions 40*a/b* of the see-through units and the single-side units have very similar constructions except for the interface with the rear closure panel 74 (for the single-side units) and the interface with the rear exterior glass panel 48 (for the see-through units). The base portions 40 of the corner units and the end caps also have similar constructions, such that the following description substantially applies to all of the base portions.

The base portions 40 have a generally U-shaped body 140 with a bottom panel 142 extending between front and rear side panels 144 and 146. The alignment rails 130 of the alignment track system 120 are attached to the under surface of the bottom panel 142. The base portion 40 also has a pair of parallel, spaced apart elongated front and rear interior support structures 148 and 150 generally parallel to the front and rear side panels 144 and 146. The front and rear interior support structures 148 and 150 are configured to receive and support the burner assembly 56 that includes a plurality of aligned burner segments 152 extending axially along the length of the base portion 40. Support screens 154 are positioned and supported along the front and rear sides of the burner segments 152. The support screens 154 provide a perforated surface in the firebox 18 adjacent to the burner segments 152 that can support noncombustible decorative materials, such as stones, simulated coal embers, clear or colored glass pieces, etc., adjacent to or over the burner segments 152. Accordingly, the fuel gas from the burner segments 152 can filter through the decorative material and burn in the firebox 18 above the burner segments 152, the support screens 154, and any decorative material thereon.

The interior support structures 148 and 150 also help support the gas lines 52 operably connected to the burner segments 152 in a conventional manner. The ends of the gas lines 52 adjacent to the end portions of the modular units with conventional fittings that allow the gas lines 52 of adjacent modular units to be interconnected. The front interior support structure 148 and the front side panel 144 are configured to help support and contain the electronic fireplace controls 54, including the burner controls that control the flow of gas from the gas lines 52 to the burner segments 152 during operation of the fireplace assembly 10.

As seen in FIG. 18, the front side panel 144 can include one or more access panels 156 that provide access to the burner segments 152, the fireplace controls 54, and the gas lines 52. These access panels 156 provide open and easy access to the module's internal components during assembly and or during adjustment of the assembly after installation. The burner segments 152 of the illustrated embodiment can include a single segment that extends the full-length of the base portion 40. Alternatively, the burner segments 152 can include a plurality of segments within a single module, and each segment is configured to connect to the gas lines 52 to receive the flow of fuel gas therein during operation of the assembly. In one embodiment, the burner segments 152 are one-foot segments each with a uniform or common constructions, such that the segments are all interchangeable and can be installed in the base portion to form a substantially continuous linear burner assembly 56 under the support screens 154 for uniform distribution of the combustion gas into the firebox during operation. Each base portion 40 can include one or more electronic fireplace control units 54, and the fireplace controls 54 of adjacent modules can be operatively coupled together and connected to a master controller of the modular linear fireplace assembly 10.

The control units 54 and/or the master controller can include on-board manipulatable, switches, or controls manipulatable by a user during operation of the assembly 10 to control aspects of the assembly. The control unit 54 and/or the master controller can be coupled to a wireless remote control unit that allows a user to control the assembly remotely. In one embodiment, the control unit 54 and/or the master controller can be configured with a conventional "Wi-Fi" control protocol coupled to a control application that can be downloaded onto a smartphone, tablet, laptop, computer, or another personal electronic device (PED). Accordingly, as an example, a user can launch the application on his or her smartphone and remotely control operation of the fireplace assembly 10 via the phone and the associated application.

The base portion 40 can also include a plurality of lights, such as LED lights 158 on a light strip connected to, as an example, the front side panel 144 adjacent to the bottom of the front exterior glass panel 48*a*. The lights 158 are also coupled to the fireplace controls 54 and configured to illuminate the interior of the modular units. The lights 158 can be configured to provide a variety of colors, patterns, and/or sequences by selectively illuminating the lights 158 during use of the modular, linear fireplace assembly 10. In the illustrated embodiment, the LED lights are attached to the body's front and/or rear side panels 144/146 below its top edge and facing upwardly, so the light projects up into the firebox. In one embodiment, the lights 158 can be controlled remotely by a user via the remote control device and/or the application on the user's smartphone, tablet, computer, laptop, or other PED.

As seen in FIGS. 17 and 18, the base portion 40 has a plurality of glass support rails 160 that receive and support the interior and exterior glass panels 46 and 48 (FIG. 7). The top edge portion of the body's front side panel 144 has a front exterior glass support rail 160*a* that securely engages and supports the unit's front exterior glass panel 48*a*. The front and rear interior support structures 148 and 150 also include interior glass support rails 160*b* and 160*c*, respectively, that securely engage and support the unit's interior glass panels 46*a/b* with the burner segments 152 and the firebox 18 therebetween. The base portion 40 of each see-through unit 20 (FIG. 18), 22 (FIG. 8B), 24 (FIG. 10) has a rear exterior glass support rail 160*d* that securely engages and supports the unit's rear exterior glass panel 48*b*. In the single-side units 28 (FIG. 7), 30 (FIG. 9), 32 (FIG. 11A), the rear side panel 146 of the base portion's body 140 does not have a glass panel rail. The top edge portion of the rear side panel 146 is connected to the bottom edge of the rear closure panel 74. This configuration with the glass support rails 160 allows glass panels to be easily installed, removed, and/or replaced.

Figure 19A:
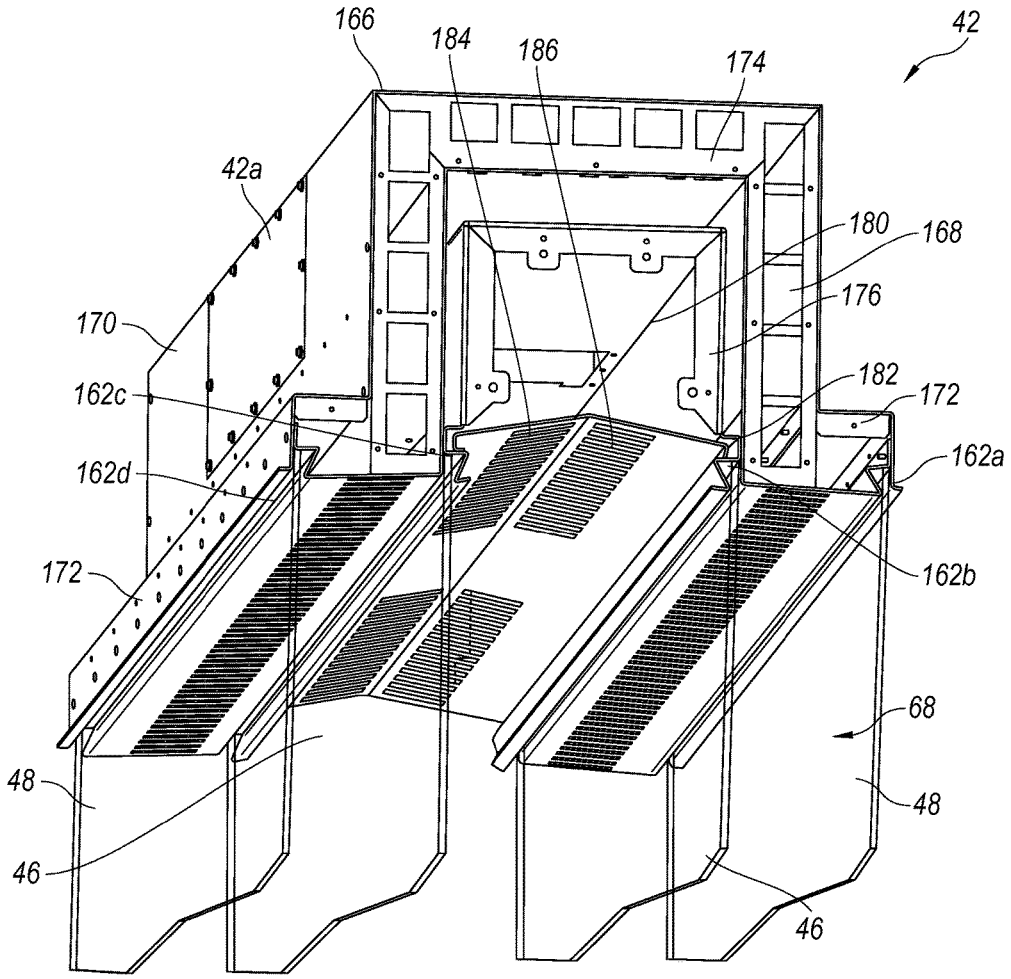
FIG. 19A is a bottom isometric view of a top portion of the modular fireplace unit of FIG. 6.
Figure 19B:
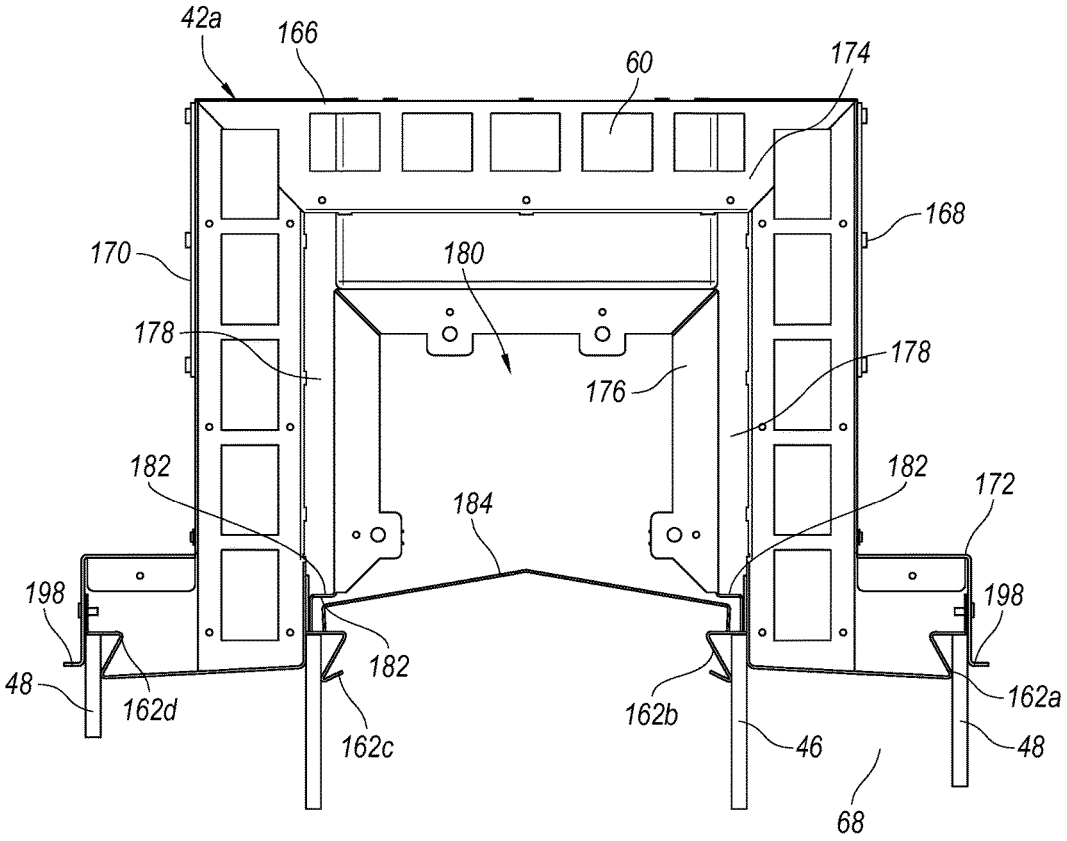
FIG. 19B is a cross-sectional view taken substantially along lines 19B-19B of FIG. 19A.

The glass panels 46/48 of the assemblies are also secured to the top portions 42 of the modular units via similar glass support rails 162. FIG. 19A is a bottom isometric view of the top portion 42*a* of the see-through linear unit 20 (FIG. 6), and FIG. 19B is a cross-sectional view taken substantially along lines 19B-19B of FIG. 19A. FIG. 17 shows the top portion 42*b* of the single-side linear unit 28. The top portions 42 of the see-through units and the single side units are substantially similar, with the exception of the interface between the rear closure panel 74 or the rear exterior glass panel 48*b*. Accordingly, the following discussion applies to all of the top portions 42. Each top portion 42 has a body portion 166 with an inverted, generally U-shaped cross sectional shape. The body portion 166 has a front side portion 168 spaced apart from a rear side portion 170, and each of the front and rear side portions have outwardly flared lower portions 172. Each of the outwardly flared lowered portions 172 of the see-through units have upper exterior glass support rails 162*a* and 162*d* positioned vertically above the exterior glass support rails 160*a* and 160*d*, respectively, of the corresponding base portion 40 (FIG. 18) discussed above. The upper exterior glass support rails 162*a/d* securely engage and support the exterior glass panels 48. As seen in FIG. 17, the top portions' rear side portion 170 of the single-side units are fastened or otherwise securely connected to the top edge of the rear closure panel 74.

The body 166 of each top portion 42 has an interior frame structure 174 attached to the front and rear side portions 168 and 170. The frame structure 174 is attached to and carries a divider channel 176 that has an inverted, generally U-shaped cross-sectional. The divider channel 176 is supported interior of and spaced apart from the front and rear side portions 168 and 170 so as to define an upper portion 178 of the combustion air passageway 68 around the outside of the divider channel 176 and adjacent to the body's front and rear side portions 168 and 170. The U-shaped divider channel 176 is positioned above the firebox 18 between the interior glass panels 48 so as to define an exhaust passageway 180 inside of the divider channel 176. The bottom edges of the divider channel 176 are connected to spaced-apart seal clips 182 also attached to the frame structure 174. These seal clips 182 also carry the upper interior glass support rails 162*b* and 162*c* that securely receive the top edges of the interior glass panels 46*a* and 46*b*, respectively. Accordingly, the interior glass panels 46, the seal clips 182, and the divider channel 176 fully separate and isolate the firebox 18 and the associated exhaust passageway 180 from the combustion air passageway 68, which extends around the divider channel 176 and between the interior and exterior glass panels 46 and 48 (or the rear interior glass panel 46*b* and the rear closure panel 74 of the single-side units).

As seen in FIGS. 17 and 19B, each the top portion 42 includes an elongated, tented baffle 184 supported atop the seal clips 182. The tented baffle 184 includes a plurality of slots 186 formed along the length of the baffle above the firebox 18. The tented shape of the baffle 184 and the number and positioning of the slots 186 help control and distribute the combustion exhaust from the firebox 18 into the exhaust passageway 180 within the divider channel 176. As discussed above, the exhaust flue 60 is attached to the top of the body portion 166 above the firebox 18. The exhaust flue 60 extends partially into the body portion 166 and sealably connects to the top of the divider channel 176 so combustion exhaust from the firebox can flow through the exhaust passageway 180 and into the exhaust flue 60 and the associated exhaust duct 62.

Each top portion 42 of at least the modular linear and corner units is configured to include an exhaust flue. A multi-module assembly 10, such as the assembly shown in FIGS. 1, 3 and 4, may only need one exhaust flue 60 and exhaust duct 62 to handle the combustion exhaust. In this configuration, other exhaust flues can be removed and the associate opening in the top of the body portion 42 is sealed with a closure panel 188, as shown in FIGS. 3 and 4. In other embodiments having larger or longer assemblies, such as shown in FIG. 2, can include more than one modular top portions having an integrated exhaust flue and exhaust duct configuration.

Each modular linear units 20, 28 is also configured to have the air intake flue 64 connected to the top of the body portion 166 and in communication with the combustion air passage 68 above and around the outside of the divider channel 176. In some embodiments, a modular corner unit 22, 30 can also have a combustion air intake flue. In other embodiments, multiple combustion air intake flues may not be needed, such that an air intake flue and its associated aperture in the body portion 166 can be sealed with a closure panel.

Figure 20A:
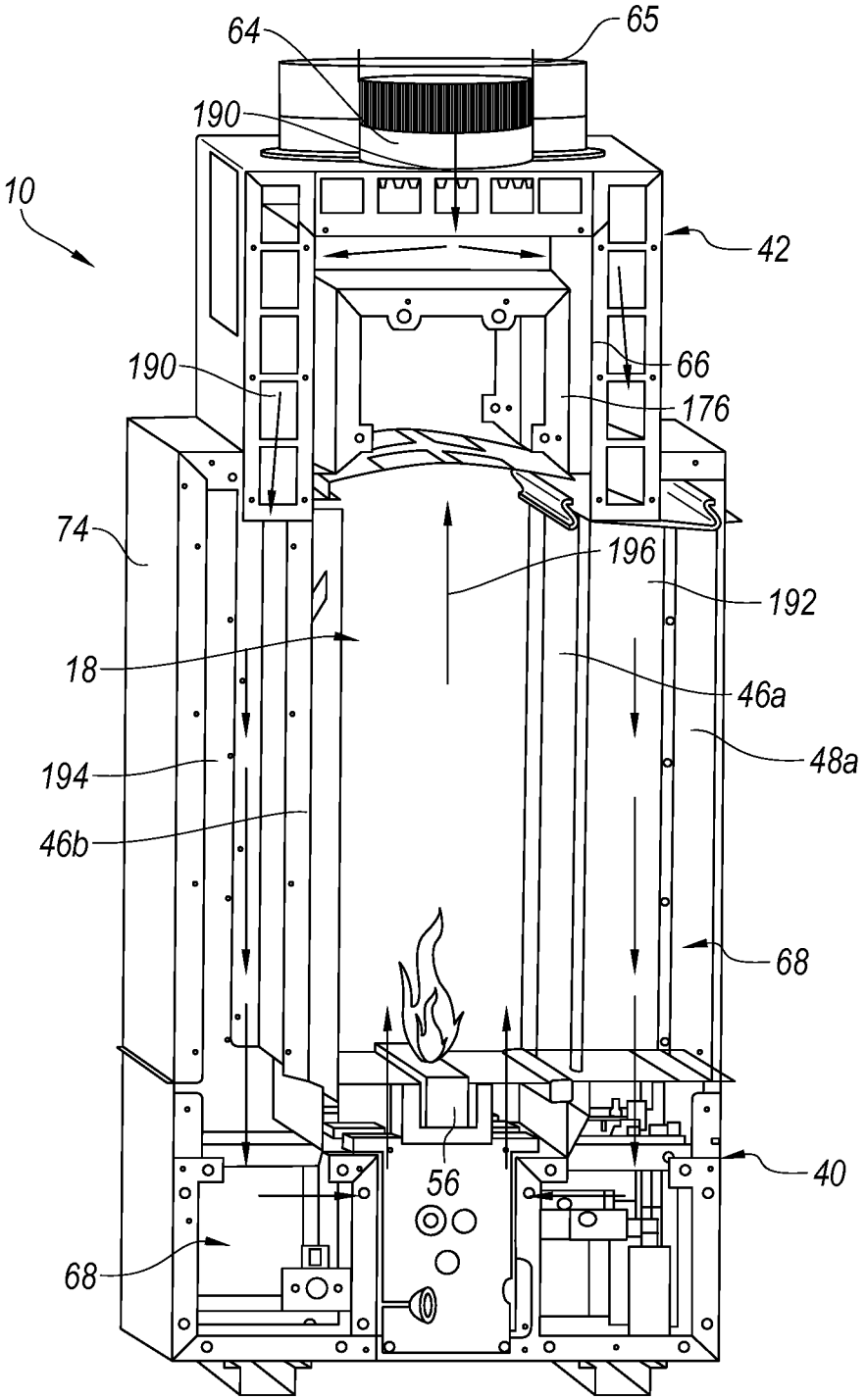
FIG. 20A is the cross-sectional isometric view of FIG. 17 illustrating the combustion air intake flow path through the modular fireplace unit to the combustion chamber.
Figure 20B:
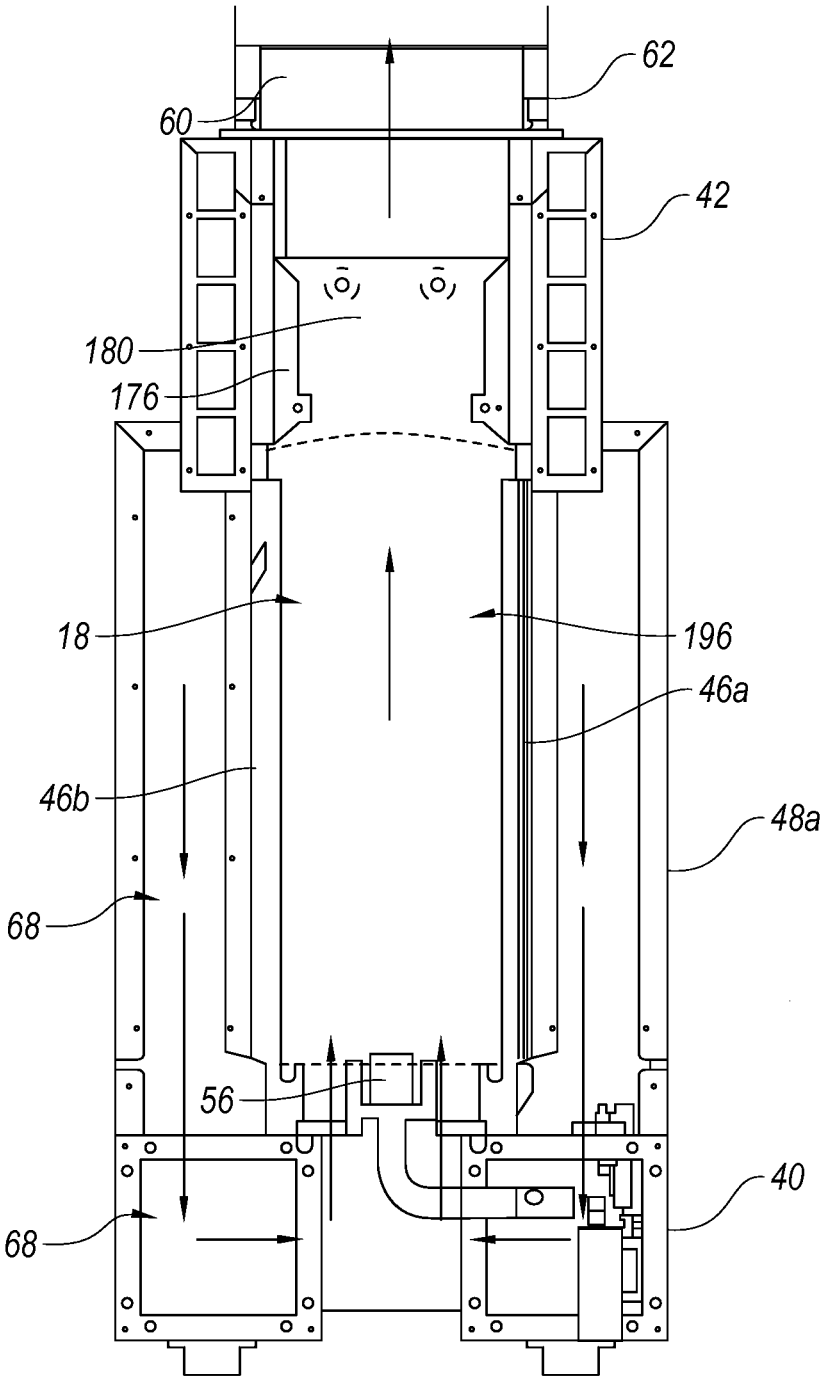
FIG. 20B is a cross-sectional isometric view taken substantially along lines 20B-20B of the modular fireplace unit of FIG. 6 illustrating the exhaust flow path from the combustion chamber out the exhaust flue.

FIG. 20A is the cross-sectional isometric view of FIG. 17 illustrating the combustion air flow path 190 through the modular fireplace unit to the combustion chamber in the firebox 18. Fresh combustion air from the air intake duct 65 (shown in broken lines) enters the assembly 10 through the combustion air intake flue 64 and flows into the combustion air chamber 66 in the top portion 42. The combustion air flows through the combustion air chamber 66, around the exterior of the divider channel 176, and flows downwardly through the forward portion 192 of the combustion air passage 68 between the forward interior and exterior glass panels 46*a* and 48*a*, and through the rear portion 194 of the combustion air passage 68 between the rear interior and exterior glass panel 46*b* and the rear closure panel 74. In the see-through units, the rear portion 194 of the combustion air passage 68 flows between the rear interior and exterior glass panels 46*b* and 48*b*. The combustion air continues to flow into and through the base portion 40 and upwardly into the firebox 18 through the support screens 154 adjacent to the burner segments 152. The combustion air facilitates combustion of the fuel gas in the firebox 18 and generation of the aesthetically pleasing flame in the firebox 18. Although the embodiment illustrated in FIG. 20A is a single-side linear unit for purposes of illustration, a substantially similar combustion air flow path is provided through the see-through and single-side corner units. A similar combustion air flow path can also be provided in the end units.

When the fuel gas and combustion air burn in the firebox 18, the resulting combustion results in exhaust that flows upwardly in the firebox 18 away from the burner assembly 56 along an exhaust path 196 into the exhaust passageway 180 in the top portion's divider channel 176, which is isolated from the upper portion 178 of the combustion air passage 68. The flow of exhaust exits the divider channel 176 through the exhaust flue 60 and flows into the exhaust duct 62 away from the assembly 10.

The configuration of the modular linear units with the air gap and the flow of combustion air exterior of the firebox 18 between the interior and exterior glass panels 46 and 48, respectively, (or between the rear interior glass panel and the rear closure panel 74) keeps the exterior surface of the units relatively cool. As the fresh combustion air flows through the combustion air passage 68 over the interior glass panels 46*a/b* and around the firebox 18, the air flow carries heat away from the exterior glass panels 48*a/b* and/or the rear closure panel 74, and the partially heated combustion air flows into the firebox 18 past the burner assemblies 56. The fresh combustion air also flows through the base portions 40 so as to keep the lights 158 and the electronic controls 54 cooled during operation of the fireplace assembly 10. Further, the configuration of the modular units, and the flow of fresh combustion air help maintain the exterior of the units at relatively low temperatures during operation and burning of the fuel gas in the firebox 18. As an example, the exterior temperatures of the units remain well below 170° F., and typically are only up to approximately 130° F.

Figure 21:
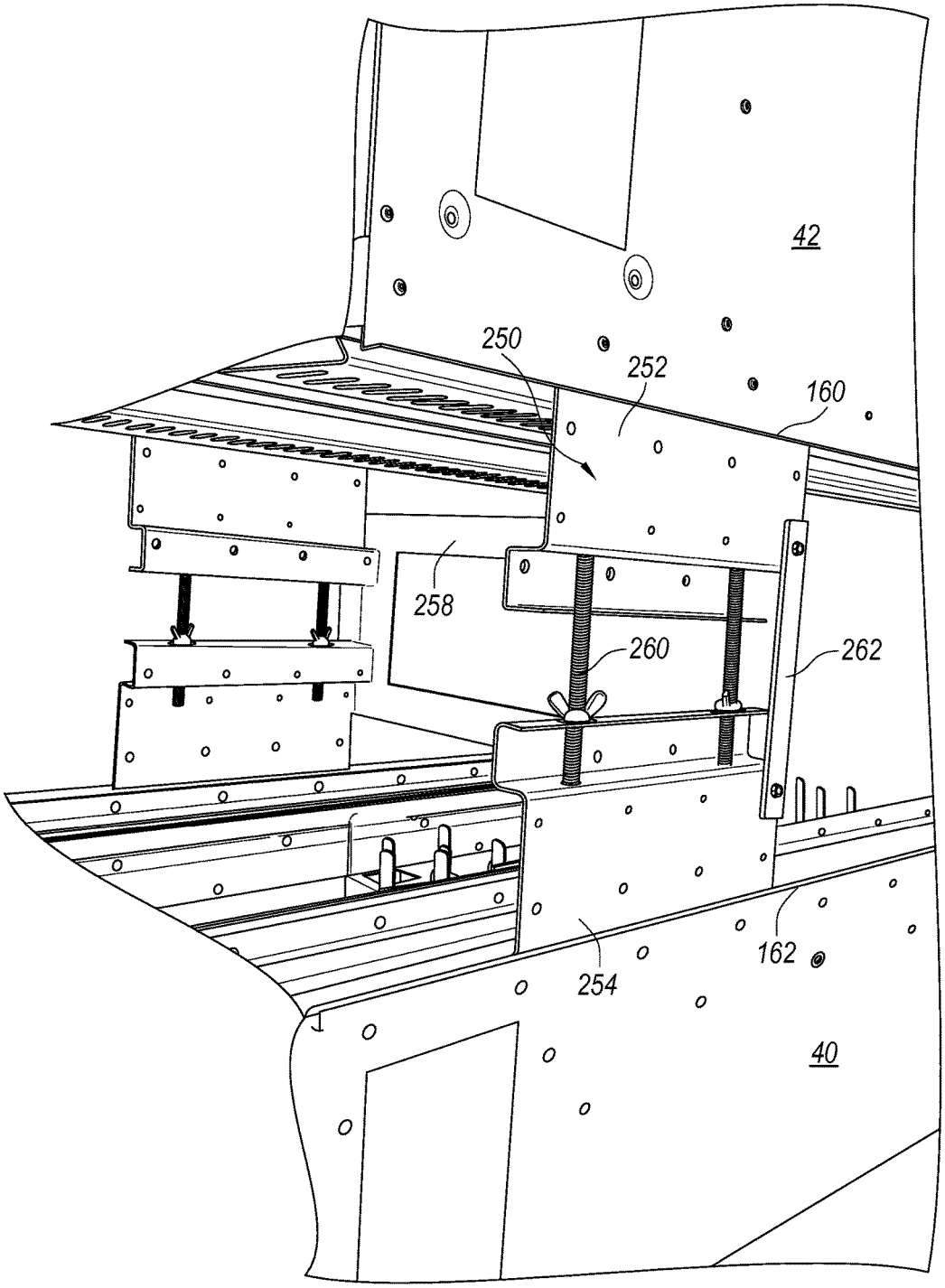
FIG. 21 is an isometric view of a modular fireplace unit in a shipping configuration with supportive, removable shipping brackets installed.

As discussed above, the modular units, such as the linear units 20, of the fireplace assembly 10 have the connector ends with the common construction that allows interconnection of selected modules without having any visible interconnecting structure in the firebox except for the abutting glass panels. Once the linear units 20 are interconnected with the other modules in a fully installed assembly 10, the adjacent base and top portions 40 and 42 are securely fixed in place relative to each other so that excessive vertical loads are not carried by or applied to the glass panels. Before the modular units are installed, such as during shipping or storage, the system of at least one embodiment includes supportive shipping brackets 250 that help support the base and top portions 40 and 42 of the units. FIG. 21 is an isometric view of a modular, see-through linear unit 20 in a shipping configuration without the glass panels installed and with the shipping brackets 250 securely connected to the base and top portions via the glass support rails 160/162, such as the exterior glass support rails 160*a/d* and 162*a/d*.

The shipping brackets 250 each have adjustably interconnected bottom and top members 252 and 254. The bottom member 252 has a linear bottom edge 256 that fits into the bottom exterior glass support rail 162*a/d*, and the top member 254 has a linear top edge 258 that fits into the top exterior glass support rail 160*a/d*. The top and bottom members 254 and 252 are interconnected by one or more axially adjustable connectors 260, such as threaded shafts that can be rotated or otherwise adjusted to increase or decrease the distance between the top and bottom members 254 and 252. Accordingly, the connectors 260 can be adjusted to secure or release the shipping brackets 250 from the respective base and top portions of the modular unit.

In one embodiment, two shipping brackets 250 are used on each end of the see-through linear units 20. Only one shipping bracket is needed for each end of the single-sided linear unit because the back closure panel 74 helps support the base and top portions 40 and 42 during shipping and/or storage. When more than one shipping bracket is used on an end of a unit, the shipping brackets can be braced together with a connector 262 to provide additional structural support and security for the modular unit during shipping and/or storage. In addition, the shipping brackets 250 can be constructed such that portions of the shipping brackets 250 can be used as hardware to securely fasten the ends of the linear units 20/28 to the ends of abutting modules during installation.

The modular units' construction and resulting low exterior temperature during operation of the assemblies also allows the assemblies to be built into installations that have combustible building products immediately adjacent to the assembly. As an example, the top portion 42 of the unit illustrated in FIG. 19B has upper finishing rails 198 and adjacent to the exterior glass support rails 162*a/d*. Similarly, the base portion 40 of the modular unit illustrated in FIG. 18 has lower finishing rails 200 adjacent to the exterior glass support rails 162*a/d*. When the modular linear fireplace assembly 10 is assembled and installed at an installation, combustible or noncombustible finish building materials, such as wall covering material or the like, can extend all the way to the finishing rails 198 and 200, so as to hide the base and top portions 40 and 42 of the assembly. This ability to use combustible building products up to the finishing rails 198 and 200 provides builders and designers significantly more flexibility for aesthetically pleasing installations.

From the foregoing, it will be appreciated that specific embodiments of the invention have been described herein for purposes of illustration, but that various modifications may be made without deviating from the invention. Additionally, aspects of the invention described in the context of particular embodiments or examples may be combined or eliminated in other embodiments. Although advantages associated with certain embodiments of the invention have been described in the context of those embodiments, other embodiments may also exhibit such advantages. Additionally, not all embodiments need necessarily exhibit such advantages to fall within the scope of the invention. Accordingly, the invention is not limited except as by the appended claims.

We claim:

1. A modular linear fireplace system, comprising:

a plurality of linear fireplace units, each having opposing front and rear portions and having opposing first attachment end portions extending between the front and rear portions and with configurations common to the linear fireplace units, wherein the linear fireplace units are interchangeable, each fireplace unit having a base portion and a top portion spaced apart from the base portion to define a firebox portion therebetween in which combustion of a fuel gas occurs during use, the base portion having a gas line and a burner assembly operatively connected to the gas line, the burner assembly being positioned adjacent to a bottom portion of the firebox portion, the firebox portion being visible through at least the front portion and having open lateral end portions adjacent to the first attachment end portions, and for each linear fireplace unit a first portion of the top portion being an upper connection portion of the first attachment end portion and a second portion of the base portion being a lower connection portion of the first attachment end portion;

wherein each linear fireplace unit is configured to be interchangeably secured to a second one of the linear fireplace units at the upper and lower connection portions of mating first attachment end portions to form joined linear fireplace units and to provide a continuous, closed elongate firebox through the joined linear fireplace units; and a plurality of end units each having second attachment end portions configured to connect to the upper and lower connection portions of the first attachment end portions of any one of the linear fireplace units, each end unit being configured to interchangeably connect to a selected one of the linear fireplace units to close one of the open lateral end portions of the firebox of the any one of the linear fireplace units, wherein the burner assembly in the base portion of each linear fireplace unit comprises a plurality of axially aligned burner segments interchangeable with each other.

2. The system of claim 1 wherein the top portion of each linear fireplace unit has an exhaust outlet and a combustion air inlet, the exhaust outlet is coupled to the firebox via an exhaust passageway configured to contain combustion exhaust from the firebox to the exhaust outlet during use; and the combustion air inlet is configured to direct combustion air to a combustion air passageway that contains and isolates the combustion air from the exhaust passageway before the combustion air enters the firebox prior to ignition with the fuel gas during use.

3. A modular linear fireplace system, comprising:

a plurality of linear fireplace units, each having a combustion air inlet and having opposing front and rear portions and having opposing first attachment end portions extending between the front and rear portions and with configurations common to the linear fireplace units, wherein the linear fireplace units are interchangeable, each fireplace unit having a base portion and a top portion spaced apart from the base portion to define a firebox portion therebetween in which combustion of a fuel gas occurs during use, the base portion having a gas line and a burner assembly operatively connected to the gas line, the burner assembly being positioned adjacent to a bottom portion of the firebox portion, the firebox portion being visible through at least the front portion and having open lateral end portions adjacent to the first attachment end portions;

wherein each linear fireplace unit is interchangeably securable to a second one of the linear fireplace units at one of the first attachment end portions to form joined linear fireplace units and to provide a continuous elongate firebox through the joined linear fireplace units; and a plurality of end units each having second attachment end portions with common configurations that mate with the first attachment end portions of any one of the linear fireplace units, each end unit being interchangeably connectable to a selected one of the linear fireplace units to close one of the open lateral end portions of the firebox of the any one of the linear fireplace units;

wherein each linear fireplace unit has an interior front divider, an interior rear divider, and an exterior front divider each extending between the top and base portions, the interior front and rear dividers are spaced apart from each other defining the firebox therebetween within which the fuel gas is delivered from the burner assembly and ignited during use, the interior front divider is between the firebox and the exterior front divider and the interior and exterior front dividers are spaced apart from each other defining a combustion air passageway isolated from the firebox and that receives combustion air from the combustion air inlet, the combustion air passageway contains a flow of the combustion air passing therethrough prior to the combustion air entering the firebox, wherein the burner assembly in the base portion of each linear fireplace unit comprises a plurality of axially aligned burner segments interchangeable with each other.

4. The system of claim 3 wherein the interior and exterior front dividers are glass panels.

5. The system of claim 3 wherein each linear fireplace unit has an exterior rear divider spaced apart from an interior rear divider with the interior rear divider positioned between the firebox and the exterior rear divider and defining at least a second portion of a combustion air passageway that contains the flow of combustion air therethrough prior to entering the firebox for combustion.

6. The system of claim 5 wherein the interior and exterior rear dividers and the interior and exterior front dividers are transparent panels configured to allow a user to see through the linear fireplace unit from front and rear sides of the linear fireplace unit.

7. The system of claim 1, further comprising an alignment track with a receiving area shaped and sized to receive the base portions of two or more adjacent linear fireplace units in a linearly aligned arrangement or to receive the base portions of a linear fireplace unit and an adjacent end unit in a linearly aligned arrangement.

8. The system of claim 7 wherein the base portions of each linear fireplace unit has one or more alignment rails, and the alignment track has a receiving area that receives the one or more alignment rails to support and align the linear fireplace units on the alignment track.

9. The system of claim 8 wherein each end unit has one or more alignment rails, and the receiving area of the alignment track is configured to receive the one or more alignment rails of the end unit to support the end unit thereon and in alignment with an adjacent linear fireplace unit positioned in the alignment track.

10. The system of claim 1, further comprising an alignment track shaped and sized to receive the base portions of two or more adjacent linear fireplace units in a linearly aligned arrangement.

11. The system of claim 1 wherein the base portion has a light system with a plurality of LED lights generally adjacent to the burner assemblies and configured to direct light upwardly toward the firebox.

12. The system of claim 1 wherein each of the linear fireplace units has a combustion air passageway that carries a flow of combustion air from the top portion through the base portion into the firebox, and the base portion of at least one linear fireplace units contains a plurality of lights positioned in or adjacent to the combustion air passageway wherein the flow of combustion air provides cooling to the lights during use.

13. The system of claim 1 wherein each linear fireplace unit includes a combustion air passageway between interior and exterior glass panels that extend between the top and base portions, with the interior glass panel being positioned between the firebox and the exterior glass panel, and the base portion having a plurality of lights adjacent to the combustion air passageway and configured to direct light upwardly toward the firebox.

14. The system of claim 1 wherein the plurality of end units include first end units each with glass panels configured to allow a user to see therethrough and into the firebox of a linear fireplace unit attached to a selected one of the first end units.

15. The system of claim 1 wherein the plurality of end units include corner units each with opposing ends having second attachment end portions configured to attach to the first attachment end portion of adjacent linear fireplace units extending away from each of the opposing ends.

16. A modular linear fireplace assembly, comprising:

first and second modular linear fireplace units, each having opposing front and rear portions and having opposing first and second attachment end portions extending between the front and rear portions, wherein the linear fireplace units are interchangeable with each other, each fireplace unit having a base portion and a top portion spaced apart from the base portion to define a firebox portion therebetween in which combustion of a fuel gas occurs during use, the base portion having a gas line and a burner assembly operatively connected to the gas line, the burner assembly being positioned adjacent to a bottom portion of the firebox portion, the firebox portion having open lateral end portions adjacent to the first and second attachment end portions, and each of the first and second attachment end portions having a first portion of the top portion defining an upper connected portion of the respective first and second attachment end portion and a second portion of the base portion defining a lower connection portion of the respective first and second attachment end portion;

a first modular end unit having at least a first end portion connected to the first attachment end portion of the first modular linear fireplace unit and positioned to close the open lateral end portion of the firebox portion of the first modular linear fireplace unit, wherein the first modular end unit having a common configuration so as to be interchangeably attachable to the first attachment end portion of the second modular linear fireplace unit; and a second modular end unit having at least a second end portion connected to the second attachment end portion of the second modular linear fireplace unit and positioned to close the open lateral end portion of the firebox portion of the second modular linear fireplace unit, wherein the second modular end unit has a common configuration so as to be interchangeably attachable to the second attachment end portion of the first modular linear fireplace unit;

wherein the first and second modular linear fireplace units are configured to be coupled together with the upper and lower connection portions of the first modular fireplace unit connected to the upper and lower connection portions of the second modular fireplace unit to provide a continuous, closed elongate firebox therethrough between the first and second modular fireplace units, wherein the burner assembly in the base portion of each linear fireplace unit comprises a plurality of axially aligned burner segments interchangeable with each other.

17. The assembly of claim 16 wherein the top portion of at least one of the first and second modular linear fireplace units has an exhaust outlet and the top portion of at least one of the first and second modular linear fireplace units has a combustion air inlet, the exhaust outlet is coupled to the firebox via an exhaust passageway configured to contain combustion exhaust from the firebox to the exhaust outlet during use; and the combustion air inlet is configured to direct combustion air to a combustion air passageway that contains and isolates the combustion air from the exhaust passageway before the combustion air enters the firebox prior to ignition with the fuel gas during use.

18. The assembly of claim 16 wherein each of the first and second modular linear fireplace units has an interior front divider, an interior rear divider, and an exterior front divider each extending between the top and base portions, the interior front and rear dividers are spaced apart from each other defining the firebox therebetween within which the fuel gas is delivered from the burner assembly and ignited during use, the interior front divider is between the firebox and the exterior front divider and the interior and exterior front dividers are spaced apart from each other defining at least a portion of a combustion air passageway that contains the flow of combustion air passing therethrough prior to entering the firebox.

19. The assembly of claim 18 wherein the interior and exterior front dividers are transparent panels.

20. The assembly of claim 18 wherein each of the first and second modular linear fireplace units has an exterior rear divider spaced apart from an interior rear divider with the interior rear divider positioned between the firebox and the exterior rear divider and defining at least a second portion of a combustion air passageway that contains the flow of combustion air therethrough prior to entering the firebox for combustion.

21. The assembly of claim 16 wherein the second attachment end portion of the first modular linear fireplace unit is connected directly to the first attachment end portion of the second modular linear fireplace unit.

22. The assembly of claim 16, further comprising an alignment track with a receiving area shaped and sized to receive the base portions of the first and second modular linear fireplace units in a coaxially aligned configuration.

23. The assembly of claim 22 wherein the base portion of each of the first and second modular linear fireplace units has one or more alignment rails, and the alignment track has a receiving area that receives the one or more alignment rails to support and align the first and second modular linear fireplace units on the alignment track.

* * * * *